US007217487B2

(12) United States Patent
Nanya et al.

(10) Patent No.: US 7,217,487 B2
(45) Date of Patent: May 15, 2007

(54) TONER, DEVELOPER USING THE SAME, TONER CONTAINER USING THE SAME, PROCESS CARTRIDGE USING THE SAME, IMAGE-FORMING PROCESS USING THE SAME AND IMAGE-FORMING APPARATUS USING THE SAME

(75) Inventors: Toshiki Nanya, Mishima (JP); Masami Tomita, Numazu (JP); Shigeru Emoto, Numazu (JP); Shinichiro Yagi, Numazu (JP); Naohiro Watanabe, Sunto-gun (JP); Tadao Takikawa, Shinjo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 11/499,686

(22) Filed: Aug. 7, 2006

(65) Prior Publication Data

US 2006/0269860 A1 Nov. 30, 2006

Related U.S. Application Data

(63) Continuation of application No. 10/733,247, filed on Dec. 12, 2003.

(30) Foreign Application Priority Data

Dec. 13, 2002 (JP) ..... 2002-363067

(51) Int. Cl.
*G03G 9/087* (2006.01)

(52) U.S. Cl. ..... 430/109.4; 430/110.3; 430/111.4

(58) Field of Classification Search ..... 430/109.4, 430/110.3, 111.4
See application file for complete search history.

(56) References Cited

U.S. PATENT DOCUMENTS

| | | | | |
|---|---|---|---|---|
| 6,103,441 | A | 8/2000 | Tomita et al. | |
| 6,363,229 | B1 | 3/2002 | Shiraishi et al. | |
| 6,395,443 | B2 | 5/2002 | Kuroda et al. | |
| 6,660,443 | B2 | 12/2003 | Sugiyama et al. | |
| 6,682,866 | B2 | 1/2004 | Sugiyama et al. | |
| 6,852,462 | B2 | 2/2005 | Emoto et al. | |
| 6,936,390 | B2 | 8/2005 | Nanya et al. | |
| 2002/0146258 | A1 * | 10/2002 | Iida et al. | 399/307 |
| 2003/0138717 | A1 * | 7/2003 | Yagi et al. | 430/110.4 |
| 2003/0152859 | A1 * | 8/2003 | Emoto et al. | 430/109.4 |

FOREIGN PATENT DOCUMENTS

| | | |
|---|---|---|
| JP | 2000-172005 | 6/2000 |
| JP | 2002-284881 | 10/2002 |
| JP | 2002-287400 | 10/2002 |
| JP | 2002-351143 | 12/2002 |

* cited by examiner

*Primary Examiner*—John L Goodrow
(74) *Attorney, Agent, or Firm*—Oblon, Spivak, McClelland, Maier & Neustadt, P.C.

(57) ABSTRACT

A toner has a storage elastic modulus (G') of 500 Pa or more at a frequency of 1 Hz and temperature of 180° C., while the toner is obtained by dissolving or dispersing a toner composition in an organic solvent, further dispersing the solution or dispersion thereof in an aqueous medium containing fine resin particles as well as being reacted with a compound having an active hydrogen group, and removing the solvent from the obtained aqueous dispersion.

18 Claims, 2 Drawing Sheets

TONER, DEVELOPER USING THE SAME, TONER CONTAINER USING THE SAME, PROCESS CARTRIDGE USING THE SAME, IMAGE-FORMING PROCESS USING THE SAME AND IMAGE-FORMING APPARATUS USING THE SAME

CROSS REFERENCE TO RELATED APPLICATIONS

This application is a continuation of U.S. patent application Ser. No. 10/733,247, filed Dec. 12, 2003, and claims priority to Japan patent application No. 2002-363067, filed Dec. 13, 2002.

BACKGROUND OF THE INVENTION

1. Field of the Invention

The present invention relates to a toner which is applied to and visualize a latent electrostatic image formed on a photoconductor in electrophotography and electrostatic recording or the like, and to a developer using the toner, a toner container, a process cartridge containing the toner, an image-forming process using the toner and an image-forming apparatus using the toner.

2. Description of the Related Art

In the prior art, an electrical or magnetic latent image formed with an electrophotography apparatus or electrostatic recording apparatus is visualized using a toner. For example, in the electrophotography method, an electrostatically charged image (latent image) is formed on a photoconductor, and this latent image is then developed using a toner to form a toner image (electrostatic charge image development). This toner image is usually transferred to a transfer medium such as paper, and subsequently fixed by a method such as heating.

In general, the toner used for the electrostatic charge image development comprises coloring particles containing a colorant, charge control agent and other additives in a binder resin, and may be manufactured, broadly speaking, by a pulverization method or a suspension-polymerization method. In the pulverization method, a toner is manufactured by melt-mixing the colorant, charge control agent and offset inhibitor, uniformly dispersing them in a thermoplastic resin, and then pulverizing and classifying the composition obtained. By the pulverization method, a toner having excellent characteristics can be manufactured, but selection of toner materials is limited. For example, the composition obtained by melt mixing must be a material which can be pulverized and classified by an economically viable apparatus. Due to this requirement, the composition which is melt-mixed must be sufficiently brittle to be pulverized and classified. Thus, when the composition is actually pulverized to particles, a particle size distribution tends to be widely ranged, and if it is attempted to obtain a copy image with good resolution and gradation, fines with a particle size of for example 5 μm or less and coarse powder of 20 μm or more must be removed, so the yield becomes very low. Moreover, it is difficult to disperse a colorant and charge control agent uniformly in a thermoplastic resin by the pulverization method. Uneven dispersion of the components has an adverse effect on toner fluidity, development and durability, and image quality.

Recently, to overcome the problems in these pulverization methods, it was proposed to manufacture the toner by a suspension-polymerization method, and this method is now being used. The technology of manufacturing a toner for latent electrostatic image development by polymerization, for example obtaining toner particles by a suspension-polymerization method, is known in the art. However, the toner particles obtained by the suspension-polymerization method are spherical, and they are not easy to clean off. In developing/transfer, when the occupation ratio of the image area is low, there is a little residual toner and poor cleaning does not pose a problem. However, when the occupation ratio of the image area is high, such as in a photographic image, toner which is not transferred after image-forming may lead to toner transfer residues on the photoconductor, and if this accumulates, a toner deposition may occur on the background of the image. Further, toner which is not transferred may contaminate the charge roller which contact charges the photoconductor, so that in some cases it cannot exhibit its original charging capability. These disadvantages become more serious if paper feed is unsatisfactory.

In order to solve these problems, a method has been disclosed for making the resin particles obtained by emulsion-polymerization aggregate so as to obtain toner particles of irregular shape (Japanese Patent Application Publication (JP-B) No. 2537503).

However, even if the toner particles obtained by emulsion-polymerization are subjected to a water rinsing step, as surfactant remains not only on the surface but also in the interior of the particles, the environmental stability of the toner charge is adversely impacted, the charge distribution is broadened, and the obtained image is soiled. Moreover, the remaining surfactant also contaminates the photoconductor, charge roller and developing roller, so that they are not able to manifest their original charging capability.

In the fixing step of the contact heating method using heating members such as a heat roller, a releasing quality (hereafter, "anti-offset quality") of the toner particles relative to the heating member is required. This anti-offset quality can be enhanced by introducing a releasing agent into the toner particle surface. Japanese Patent Application Laid-open (JP-A) No. 2000-292973 and JP-A No. 2000-292978 disclose a method of improving anti-offset quality not only by incorporating fine resin particles in the toner particles, but also by unevenly dispersing these fine resin particles on the toner particle surface. However, in these methods, the minimum fixing temperature rises, and the low-temperature fixing quality, i.e., energy-saving fixing quality, is not sufficient.

The following problems are also caused when the resin particles obtained by emulsion-polymerization are made to aggregate so as to obtain toner particles of irregular shape.

Firstly, when making releasing agent particles aggregate to improve the anti-offset quality, these releasing agent particles are taken into the interior of the toner particles, and as a result, a full improvement of the anti-offset quality cannot be realized. Secondly, as the fine resin particles, releasing agent particles and colorant particles stick together randomly to form the toner particles, variations occur in the composition (component proportions) of the toner particles, and scatter occurs in the molecular weight of the component resin. As a result, the toner particles have different surface characteristics, and an image which is stable over a long period of time cannot be formed. Thirdly, in low-temperature fixing systems wherein low-temperature fixing is required, fixing is inhibited by the resin particles which are unevenly dispersed on the toner surface, and the fixing temperature width cannot be ensured.

In order to solve these problems, JP-A No. 2002-169336 discloses a method of obtaining irregular toner particles by dissolving or dispersing a toner composition containing a toner binder resin (i) comprising a modified polyester resin capable of reacting with compounds having active hydrogen groups in an organic solvent, dispersing this solution or dispersion in an aqueous medium comprising fine resin particles, reacting this with a compound having an active hydrogen group, and then removing the solvent from the dispersion obtained so as to obtain irregular toner particles. However, in this method, if this crosslinking or elongation reaction is inadequate, new problems arise, i.e., the obtained toner particles acquire a strong positive electrostatic charge, the environmental stability of the negative toner charge is lost, the charging amount distribution is broadened, and the obtained image is badly soiled.

Advantages and Objects

It is therefore a first object of the present invention to provide a toner which gives a sharp negative electrostatic toner charging distribution, and which can form good, clear, visible images over a long period of time.

It is a second object of the present invention to provide a toner which is always easy to clean, is suitable for low-temperature fixing systems, has good anti-offset qualities, and does not soil the fixing apparatus and image.

It is a third object of the present invention to provide a developer containing the aforesaid toner, a process cartridge, image-forming process and image-forming apparatus using this toner, and a toner container filled with the developer containing this toner.

SUMMARY OF THE INVENTION

As a result of intensive studies, the present inventors found that in a method of dissolving or dispersing a toner composition containing a modified polyester resin (i) capable of reacting with compounds having active hydrogen groups in an organic solvent, dispersing this solution or dispersion in an aqueous medium comprising fine resin particles, reacting this with a compound having an active hydrogen group, and removing the solvent from the obtained dispersion so as to obtain toner particles, it was necessary to crosslink or extend the modified polyester resin capable of reacting with compounds containing an active hydrogen group with a compound having an active hydrogen group so as to decrease the compound having active hydrogen group in the toner particles, and thereby arrived at the present invention.

Specifically, the present invention provides a negative electrostatic toner, a developer, a container filled with the same, an image-forming process and an image-forming apparatus.

The first aspect of the present invention is a toner having a storage elastic modulus (G') of from 500 Pa to 10,500 Pa at a frequency of 1 Hz and temperature of 180° C. The toner composition thereof contains a binder resin which contains a modified polyester resin (i) capable of reacting with a compound having an active hydrogen group. To obtain the toner, the toner composition is firstly dissolved or dispersed in an organic solvent so as to form a solution or dispersion, then the solution or the dispersion is further dispersed in an aqueous medium containing fine resin particles having an average particle diameter of 500 nm or less as well as being reacted with a compound having an active hydrogen group, so as to form an aqueous dispersion, and finally, the obtained aqueous dispersion is removed the solvent therefrom.

The second aspect of the present invention is a toner according to the first aspect wherein the storage elastic modulus (G') is from 700 Pa to 7,000 Pa at a frequency of 1 Hz and a temperature of 180° C.

The third aspect of the present invention is a toner according to the first aspect wherein the binder resin contains a modified polyester resin (i) and a non-modified polyester resin (ii), and the weight ratio of the modified polyester resin (i) to the non-modified polyester resin (ii), is 5/95 to 75/25.

The fourth aspect of the present invention is a toner according to the first aspect wherein the binder resin has an acid value of from 0.5 mgKOH/g to 40 mgKOH/g.

The fifth aspect of the present invention is a toner according to the first aspect wherein the binder resin has a glass transition temperature (Tg) of from 40° C. to 70° C.

The sixth aspect of the present invention is a toner according to the first aspect wherein the fine resin particles are particles of a vinyl resin, a polyurethane resin, an epoxy resin, a polyester resin, or a mixture thereof.

The seventh aspect of the present invention is a toner according to the first aspect wherein the fine resin particles have an average particle diameter of from 5 nm to 500 nm.

The eighth aspect of the present invention is a toner according to the first aspect wherein the fine resin particles have a volume average particle diameter of from 4 μm to 8 μm.

The ninth aspect of the present invention is a toner according to the first aspect wherein the toner consists of toner particles which have a ratio of a volume average particle diameter (Dv) to a number average particle diameter (Dn) being from 1.10 to 1.25.

The tenth aspect of the present invention is a toner according to the first aspect wherein the toner consists of toner particles which have an average circularity of 0.90 to 0.96.

The eleventh aspect of the present invention is a toner according to the first aspect wherein the toner consists of toner particles which are in a spindle shape.

The twelfth aspect of the present invention is a toner according to the first aspect wherein the toner consists of toner particles in which the toner particles have a major axis $r_1$, a minor axis $r_2$, and a thickness $r_3$, a ratio of the major axis $r_1$ to the minor axis $r_2$ is from 0.5 to 0.8 and a ratio of the thickness $r_3$ to the minor axis $r_2$ is from 0.7 to 1.0.

The thirteenth aspect of the present invention is a toner according to the first aspect wherein the removal of the solvent is carried out by at least stirring and/or heating of the aqueous dispersion.

The fourteenth aspect of the present invention is a developer wherein the developer contains the toner according to the first aspect.

The fifteenth aspect of the present invention is an image-forming process which contains the steps of: uniformly charging a surface of a photoconductor and emitting light to the surface of the photoconductor imagewise so as to form a latent electrostatic image; supplying a toner to the surface of the photoconductor so that the latent electrostatic image is visualized to form a toner image; transferring the toner image to a recording medium; and recovering the remained toner on the photoconductor after the step of transferring and re-using the recovered toner in the step of supplying, wherein the toner is the toner according to the first aspect.

The sixteenth aspect of the present invention is a toner container which contains a container and a developer loaded in the container. The developer contains the toner according to the first aspect.

The seventeenth aspect of the present invention is an image-forming apparatus which contains a photoconductor;

a developing unit configured to form a latent electrostatic image on a photoconductor and supply a toner to the surface of the photoconductor so that a latent electrostatic image formed on the photoconductor is visualized to form a toner image; a transfer unit configured to transfer the toner image to a recording medium; and a recycle unit configured to recover the remained toner on the photoconductor after the toner image is transferred, and re-use the toner in the developing unit, wherein the toner is the toner according to the first aspect.

The eighteenth aspect of the present invention is a process cartridge which contains a photoconductor; and a developing unit for supplying a toner to a latent electrostatic image formed on the photoconductor so as to form a visualized toner image, wherein the toner is the toner according to the first aspect.

DESCRIPTION OF THE PREFERRED EMBODIMENTS

Figure 1A:
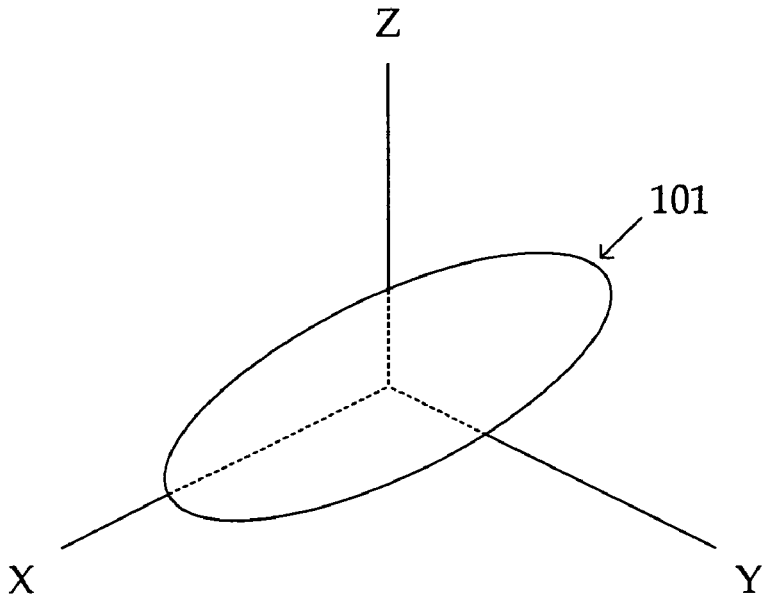
FIG. 1A is a diagram showing an example of elliptic shaped toner particles.

The negatively charged toner of the present invention is obtained by dissolving or dispersing a toner composition which contains a toner binder resin containing a modified polyester resin (i), capable of reacting with compounds having active hydrogen groups in an organic solvent, dispersing this solution or dispersion in an aqueous medium containing fine resin particles, reacting this with a compound having an active hydrogen group, and removing the solvent from the dispersion obtained.

In the present invention, the toner composition which contains the toner binder resin containing the modified polyester resin (i) capable of reacting with compounds having an active hydrogen group, is dissolved or dispersed in an organic acid to give a solution or a dispersion. Examples of the organic solvent which can be used are solvents which are inert to the polyisocyanate (3) described hereinafter, such as aromatic solvents (toluene, xylene and the like), ketones (acetone, methyl ethyl ketone, methylisobutylketone and the like), esters (ethyl acetate and the like), amides (dimethylformamide, diemthylacetamide and the like) and ethers (tetrahydrofuran and the like).

Examples of the modified polyester resin (i) capable of reacting with the compound containing an active hydrogen group, are polyester prepolymers having an isocyanate group and the like. Examples of the polyester prepolymer (A) having an isocyanate group are condensates of a polyol (1) and a polycarboxylic acid (2), wherein the resulted polyester having an active hydrogen group is further reacted with the polyisocyanate (3). Examples of the active hydrogen group in the aforesaid polyester are a hydroxyl group (alcoholic hydroxyl group or phenolic hydroxyl group), an amino group, a carboxyl group or a mercapto group. Of these, an alcoholic hydroxyl group is preferred.

Examples of the polyol (1) include diols (1-1) and trihydric or higher polyols (1-2). As the polyol (1), a diol (1-1) alone or a mixture of a diol (1-1) and a small amount of a polyol (1-2) is preferred. Examples of the diols (1-1) include alkylene glycols such as ethylene glycol, 1,2-propylene glycol, 1,3-propylene glycol, 1,4-butanediol, 1,6-hexanediol and the like; alkylene ether glycols such as diethylene glycol, triethylene glycol, dipropylene glycol, polyethylene glycol, polypropylene glycol, polytetramethylene ether glycol and the like; alicyclic diols such as 1,4-cyclohexanedimethanol, hydrogenated bisphenol A and the like; bisphenols such as bisphenol A, bisphenol F, bisphenol S and the like; alkylene oxide (e.g., ethylene oxide, propylene oxide, and butylene oxide) adducts of the aforementioned alicyclic diols; and alkylene oxide (e.g., ethylene oxide, propylene oxide, and butylene oxide) adducts of the aforementioned bisphenols. Among them, alkylene glycols each having 2 to 12 carbon atoms, and alkylene oxide adducts of bisphenols are preferred, of which alkylene oxide adducts of bisphenols alone or in combination with any of alkylene glycols having 2 to 12 carbon atoms are typically preferred.

The tri- or higher polycarboxylic acids (2-2) include, for example, aromatic polycarboxylic acids each having 9 to 20 carbon atoms, such as trimellitic acid and pyromellitic acid. An acid anhydride or lower alkyl ester (e.g., methyl ester, ethyl ester, and propyl ester) of any of the polycarboxylic acids can be used as the polycarboxylic acid (2) to react with the polyol (1).

The ratio of the polyol (1) to the polycarboxylic acid (2) in terms of the equivalence ratio [OH]/[COOH] of the hydroxyl groups [OH] to the carboxyl groups [COOH] is from 2/1 to 1/1, preferably from 1.5/1 to 1/1, and more preferably from 1.3/1 to 1.02/1.

The polyisocyanate (3) includes, but is not limited to, aliphatic polyisocyanates such as tetramethylene diisocyanate, hexamethylene diisocyanate, 2,6-diisocyanatomethyl caproate and the like; alicyclic polyisocyanates such as isophorone diisocyanate, cyclohexylmethane diisocyanate and the like; aromatic diisocyanates such as tolylene diisocyanate, diphenylmethane diisocyanate and the like; aromatic-aliphatic diisocyanates such as $\alpha,\alpha,\alpha',\alpha'$-tetramethylxylylene diisocyanate and the like; isocyanurates; blocked products of the polyisocyanates with, for example, phenol derivatives, oximes, or caprolactams; and mixtures of these compounds.

The amount of the polyisocyanate (3) in terms of the equivalence ratio [NCO]/[OH] of isocyanate groups [NCO] to hydroxyl groups [OH] of the polyester is from 5/1 to 1/1, preferably from 4/1 to 1.2/1, and more preferably from 2.5/1 to 1.5/1. If the ratio [NCO]/[OH] is more than 5, image-fixing properties at low temperatures may deteriorate. If the ratio [NCO/[OH] is less than 1, a urea content in the modified polyester decreases, and the toner may have deteriorated hot offset resistance.

The content of the polyisocyanate (3) in the prepolymer (A) having an isocyanate group is from 0.5% by weight to 40% by weight, preferably from 1% by weight to 30% by weight, and more preferably from 2% by weight to 20% by weight. If the content is less than 0.5% by weight, the hot off-set resistance may deteriorate, and satisfactory storage stability at high temperatures and image-fixing properties at low temperatures may not be obtained concurrently. If the content is more than 40% by weight, the image-fixing properties at low temperatures may deteriorate.

The prepolymer (A) generally has, in average, 1 or more, preferably 1.5 to 3, and more preferably 1.8 to 2.5 isocyanate groups per molecule. At less than 1 per molecule, the molecular weight of the modified polyester after the crosslinking reaction and/or elongation reaction decreases, and resistance to hot offset is poor.

The trihydric or higher polyols (1-2) include, for example, trihydric or higher aliphatic alcohols such as glycerol, trimethylolethane, trimethylolpropane, pentaerythritol, sorbitol and the like; trihydric or higher phenols such as trisphenol PA, phenol novolacs, cresol novolacs and the like; and alkylene oxide adducts of these trihydric or higher polyphenols. The polycarboxylic acid (2) includes, for example, dicarboxylic acids (2-1) and tri- or higher polycarboxylic acids (2-2). As the polycarboxylic acid (2), a dicarboxylic acid (2-1) alone or in combination with a small amount of a tri- or higher polycarboxylic acid (2-2) is preferred. The dicarboxylic acids (2-1) include, but are not limited to, alkylenedicarboxylic acids such as succinic acid, adipic acid, sebacic acid and the like; alkenylenedicarboxylic acids such as maleic acid, fumaric acid and the like; aromatic dicarboxylic acids such as phthalic acid, isophthalic acid, terephthalic acid, naphthalenedicarboxylic acid and the like. Among them, preferred are alkenylenedicarboxylic acids each having 4 to 20 carbon atoms and aromatic dicarboxylic acids each having 8 to 20 carbon atoms.

In the present invention, the modified polyester resin (i) can be used alone or in combination with an unmodified polyester resin (ii) as the binder resin component of the toner. The combination use of the modified polyester resin (i) with the unmodified polyester resin (ii) may improve the image-fixing properties at low temperatures and glossiness upon use in a full-color apparatus.

Examples and preferred examples of the unmodified polyester resin (ii) are polycondensation products of a polyol (1) and a polycarboxylic acid (2) as in the polyester components of the modified polyester resin (i). The unmodified polyester resins (ii) include unmodified polyesters as well as polyesters modified with a urethane bond and other chemical bonds except urea bonds. The modified polyester resin (i) and the unmodified polyester resin (ii) are preferably at least partially compatible or miscible with each other for better image-fixing properties at low temperatures and hot offset resistance. Accordingly, the polyester components of the modified polyester resin (i) and the unmodified polyester resin (ii) preferably have similar compositions to each other. The weight ratio of the modified polyester resin (i) to the unmodified polyester resin (ii), if any, is from 5/95 to 72/25, preferably from 10/90 to 25/75, more preferably from 12/88 to 25/75, and typically preferably from 12/88 to 22/78. If the weight ratio is less than 5/95, the hot offset resistance may deteriorate, and satisfactory storage stability at high temperatures and image fixing properties at low temperatures may not be obtained concurrently. On the other hand, when the weight ratio of (i) is more than 75/25, the lower limit fixing temperature increases, and fixing cannot be performed in a low temperature fixing system.

The peak molecular weight of the resin (ii) is from 1,000 to 30,000, preferably from 1,500 to 10,000, and more preferably from 2,000 to 8,000. If the peak molecular weight is less than 1,000, the heat-resistant storage stability may deteriorate, and if it is more than 10,000, the image-fixing properties at low temperatures may deteriorate. The hydroxyl value of the resin (ii) is preferably 5 or more, more preferably from 10 to 120, and typically preferably from 20 to 80. If the hydroxyl value is less than 5, satisfactory heat-resistant storage stability and image-fixing properties at low temperatures may not be obtained concurrently.

The acid value of the resin (ii) is 0.5 to 40, and preferably 5 to 35. By increasing the acid value, the negative charging quality increases. Also, when the acid value and hydroxyl value respectively exceed this range, in a high temperature, high humidity environment, or a low temperature, low humidity environment, there is more sensitivity to the effect of the environment which leads to image deterioration.

As the acid value of the resin (i) is close to zero, the acid value of the toner binder resin is determined by the acid value of the resin (ii). Therefore, when the acid value of the resin (ii) is 0.5 to 40, the acid value of the toner binder resin is also 0.5 to 40.

In the present invention, the glass transition point Tg of the toner binder resin is from 40° C. to 70° C., and preferably from 45° C. to 65° C. If the glass transition point is lower than 40° C., the storage stability at high temperatures of the toner may deteriorate, and if it is higher than 70° C., the image-fixing properties at low temperatures may be insufficient. By using the urea-modified polyester, the toner of the present invention, even with a low glass transition point, shows more satisfactory heat-resistant storability than conventional polyester toners.

The modified polyester resin (i) which can react with a compound having an active hydrogen group in the present invention, can be manufactured by the following method.

A polyol (1) and a polycarboxylic acid (2) are heated at 150° C. to 280° C. in the presence of a known esterification catalyst such as tetrabutyl titanate or dibutyltin oxide, and produced water is removed by distillation where necessary under a reduced pressure to thereby yield a polyester having a hydroxyl group. The polyester is allowed to react with a polyisocyanate (3) at 40° C. to 140° C. and thereby yields a polyester prepolymer (A) having an isocyanate group. If an amine is for example used as the crosslinking agent or extender, an amine (B) is reacted with the polyester prepolymer (A) at 0° C. to 140° C. to obtain a polyester modified by urea bonds. In the reactions between the polyester and the polyisocyanate (3) and between the prepolymer (A) and the amine (B), solvents can be used according to necessity. Such solvents for use herein include, for example, aromatic solvents such as toluene, xylene and the like; ketones such as acetone, methyl ethyl ketone, methyl isobutyl ketone and the like; esters such as ethyl acetate; amides such as dimethylformamide, dimethylacetamide and the like; and ethers such as tetrahydrofuran, and other solvents inert to the isocyanate (3).

When the unmodified polyester resin (ii) is used in combination with the urea-modified polyester resin (i), the unmodified polyester resin (ii) is prepared in the same manner as in the polyester having a hydroxyl group, and then the unmodified polyester resin (ii) is dissolved and mixed into the solution after the completion of the reaction of the urea-modified polyester resin (i).

In the present invention, the aforesaid solution or dispersion is then dispersed in an aqueous medium containing fine resin particles, and reacted with a compound having an active hydrogen group.

Aqueous media for manufacturing a toner may include water alone or in combination with an organic solvent that is miscible with water. Such miscible organic solvents include, but are not limited to, alcohols such as methanol, isopropyl alcohol, ethylene glycol and the like; dimethylformamide; tetrahydrofuran; Cellosorves such as methyl cellosolve and the like; and lower ketones such as acetone, methyl ethyl ketone and the like.

The fine resin particles contained in the aforesaid aqueous medium are not specifically limited, as long as they can form a water-based or aqueous dispersion, and can be any of thermoplastic resins and thermosetting resins. Examples of the resins include vinyl resins, polyurethane resins, epoxy resins, polyester resins, polyamide resins, polyimide resins, silicone resins, phenolic resins, melamine resins, urea resins, aniline resins, ionomer resins, and polycarbonate resins. The fine resin particles may comprise two or more types of these resins. Among them, vinyl resins, polyurethane resins, epoxy resins, polyester resins, and mixtures thereof are preferred for yielding an aqueous dispersion of fine spherical resin particles.

Examples of the vinyl resins are homopolymers and copolymers of vinyl monomers, such as styrene-(meth) acrylic ester copolymers, styrene-butadiene copolymers, (meth)acrylic acid-acrylic ester copolymers, styrene-acrylonitrile copolymers, styrene-maleic anhydride copolymers, and styrene-(meth)acrylic acid copolymers.

The average particle diameter of the fine resin particles used in the present invention is 500 nm or less, preferably 5 nm to 500 nm, and more preferably 30 nm to 120 nm. At less than 5 nm, emulsification may not occur and the product may become cake-like, whereas at more than 500 nm, the particle size distribution during emulsification becomes large, and the particle size distribution of the toner is not sharp.

In the present invention, the aforesaid solution or dispersion in the aqueous medium containing fine resin particles, is made to react with the compound having an active hydrogen group. More specifically, it can for example be obtained by reacting a dispersion comprising the polyester prepolymer (A) having the aforesaid isocyanate group with the amine (B) in an aqueous medium. The dispersion comprising the polyester prepolymer (A) may be formed stably in an aqueous medium for example by adding a toner material composition comprising the polyester prepolymer (A) to an aqueous medium to disperse it by shear force. In addition to the polyester prepolymer (A), other toner compositions (hereafter, referred to as toner materials) such as a colorant, colorant master batch, releasing agent, charge control agent or polyester resin (ii) that has not been modified may be mixed when forming the dispersion in the aqueous media, but the toner materials are preferably first mixed, and the mixture then added to and dispersed in the aqueous media. Also, according to the present invention, it is not necessary to mix other toner materials, such as a colorant, releasing agent and charge control agent when forming particles in the aqueous media, and these may be added after forming the particles. For example, after forming particles which do not contain colorant, a colorant can be added by the known method of staining.

The time of the crosslinking elongation reaction and/or elongation reaction is appropriately set depending on the reactivity derived from the combination of the isocyanate structure of the polyester prepolymer (A) to the amine (B) and is from 10 minutes to 40 hours and preferably from 30 minutes to 12 hours. The reaction temperature is from 0° C. to 150° C. and preferably from 15° C. to 45° C. Where necessary, a known catalyst such as dibutyltin laurate and dioctyltin laurate can be used. It is particularly preferred to form the emulsified dispersion by stirring and maturing at 20° C. to 35° C. for 30 minutes to 6 hours after emulsification.

In the present invention, the reason for including fine resin particles in the aqueous media is to control the toner particle diameter and distribution by the fine resin particles. However, if the crosslinking reaction or elongation reaction is inadequate, fine resin particles cover the outermost surface of the toner particles, and even if subsequent washing is performed, the compound having an unreacted active hydrogen group tends to remain near the toner surface. This remaining compound having an active hydrogen group makes charge control unstable. In particular, if an amine is used as the compound having an active hydrogen group for the polyester prepolymer (A) having an isocyanate group, this remaining compound has a positive charging quality and leads to an unstable negative electrostatic quality. In order to prevent this problem, it is important to make the polyester prepolymer having an isocyanate group undergo the crosslinking reaction and/or elongation reaction to a sufficient extent.

In the present invention, an amine can be used as the compound having an active hydrogen group. The amine (B) includes, for example, diamines (B1), tri- or higher polyamines (B2), amine alcohols (B3), aminomercaptans (B4), amino acids (B5), and amino-blocked products (B6) of the amines (B1) to (B5). The diamines (B1) include, but are not limited to, aromatic diamines such as phenylenediamine, diethyltoluenediamine, 4,4'-diaminodiphenylmethane and the like; alicyclic diamines such as 4,4'-diamino-3,3'-dimethyldicyclohexylmethane, diaminocyclohexanes, isophoronediamine and the like; and aliphatic diamines such as ethylenediamine, tetramethylenediamine, and hexamethylenediamine.

The tri- or higher polyamines (B2) include, for example, diethylenetriamine, triethylenetetramine and the like. The amino alcohols (B3) include, but are not limited to, ethanolamine, hydroxyethylaniline and the like. The aminomercaptans (B4) include, for example, aminoethyl mercaptan, aminopropyl mercaptan and the like. The amino acids (B5) include, but are not limited to, aminopropionic acid, aminocaproic acid and the like.

The amino-blocked products (B6) of the amines (B1) to (B5) includes ketimine compounds and oxazoline compounds derived from the amines (B1) to (B5) and ketones such as acetone, methyl ethyl ketone, and methyl isobutyl ketone. Among these amines (B), preferred is the diamine (B1) alone or in combination with a small amount of the polyamine (B2).

Further, in the crosslinking reaction and/or elongation reaction, the molecular weight of the modified polyester after the reaction is complete can be adjusted using a blocking agent if required. Such blocking agents include, but are not limited to, monoamines such as diethylamine, dibutylamine, butylamine, laurylamine and the like; and blocked products (ketimine compounds) of these monoamines.

The content of the amine (B) in terms of the equivalence ratio [NCO]/[NHx] of isocyanate groups [NCO] in the prepolymer (A) to amino groups [NHx] of the amine (B) is from 1/2 to 2/1, preferably from 1.5/1 to 1/1.5 and more preferably from 1.2/1 to 1/1.2. If the ratio [NCO]/[NHx] is more than 2/1 or is less than 1/2, the obtained urea-modified polyester (i) may have a low molecular weight, and the hot off-set resistance may deteriorate.

The usage amount of the aqueous medium relative to 100 parts by weight of the toner composition containing the modified polyester resin (i), such as the polyester prepolymer (A), is normally 50 parts by weight to 2,000 parts by weight, and preferably 100 parts by weight to 1,000 parts by weight. If the amount is less than 50 parts by weight, the toner composition may not be dispersed sufficiently, and the resulting toner particles may not have a target particle diameter. If it is more than 2,000 parts by weight, it is not economical. Preferably, a dispersing agent is used in the dispersing procedure for sharper particle distribution and more stable dispersion of the toner particles.

The usage amount of the aqueous solvent relative to 100 parts by weight of the modified polyester resin (i), such as the polyester prepolymer (A), is normally 0 part by weight to 300 parts by weight, preferably 0 part by weight to 100 parts by weight, and more preferably 25 parts by weight to 70 parts by weight. The aqueous solvent, if used, is removed by heating at normal atmospheric pressure or under a reduced pressure after the elongation and/or crosslinking reaction.

In the present invention, the aforesaid solution or dispersion is dispersed in the aqueous medium containing fine resin particles. The dispersing procedure is not specifically limited and includes known procedures such as low-speed shearing, high-speed shearing, dispersing by friction, high-pressure jetting, and ultrasonic dispersion. To allow the dispersed particles to have an average particle diameter of 2 μm to 20 μm, the high-speed shearing procedure is preferred. When a high-speed shearing dispersing machine is used, the number of rotation is not specifically limited and is generally from 1,000 rpm to 30,000 rpm and preferably from 5,000 rpm to 20,000 rpm. The dispersion time is not specifically limited and is generally from 0.1 minutes to 5 minutes in a batch system. The dispersing temperature is generally from 0° C. to 150° C. under a pressure (under a load) and preferably from 40° C. to 98° C. A high dispersing temperature is preferred, since the dispersion comprising the urea-modified polyester resin (i) or the prepolymer (A) has a low viscosity and can be dispersed more easily.

In the present invention, the dispersing agent for emulsifying and dispersing the aforesaid solution or dispersion (oil phase in which the toner composition was dispersed), in the aqueous media containing fine resin particles, is anionic surfactants such as alkylbenzene sulfonates, α-olefin sulfonates, phosphoric esters, and the like; quaternary ammonium salts cationic surfactants such as alkylamine salts, amino alcohol fatty acid derivatives, polyamine fatty acid derivatives, imidazoline, and other amine salts cationic surfactants, alkyltrimethylammonium salts, dialkyldimethylammonium salts, alkyldimethylbenzylammonium salts, pyridinium salts, alkylisoquinolinum salts, benzethonium chloride, and the like; nonionic surfactants such as fatty acid amide derivatives, polyhydric alcohol derivatives, and the like; amphoteric surfactants such as alanine, dodecyl di(aminoethyl)glycine, di(octylaminoethyl)glycine, N-alkyl-N,N-dimethylammonium betaines, and the like.

By using a surfactant having a fluoroalkyl group, an emulsification and dispersion effect can be obtained with a very small amount thereof. Preferred examples of fluoroalkyl-containing anionic surfactants are fluoroalkylcarboxylic acids each containing 2 to 10 carbon atoms, and metallic salts thereof, disodium perfluorooctanesulfonyl glutamate, sodium 3-[omega-fluoroalkyl($C_6$–$C_{11}$)oxy]-1-alkyl($C_3$–$C_4$) sulfonate, sodium 3-[omega-fluoroalkanoyl($C_6$–$C_8$)—N-ethylamino]-1-propanesulfonate, fluoroalkyl ($C_{11}$–$C_{20}$) carboxylic acids and metallic salts thereof, perfluoroalkyl carboxylic acids ($C_7$–$C_{13}$) and metallic salts thereof, perfluoroalkyl ($C_4$–$C_{12}$) sulfonic acids and metallic salts thereof, perfluorooctanesulfonic acid diethanolamide, N-propyl-N-(2-hydroxyethyl)perfluorooctanesulfonamide, perfluoroalkyl ($C_6$–$C_{10}$) sulfonamide propyl trimethyl ammonium salts, perfluoroalkyl ($C_6$–$C_{10}$)—N-ethylsulfonyl glycine salts, and monoperfluoroaklyl ($C_6$–$C_{16}$) ethyl phosphoric esters. Such fluoroalkyl-containing anionic surfactants are commercially available under the trade names of, for example, SURFLON S-111, S-112 and S-113 (from Asahi Glass Co., Ltd.), FLUORAD FC-93, FC-95, FC-98 and FC-129 (from Sumitomo 3M Limited), UNIDYNE DS-101 and DS-102 (from Daikin Industries, Ltd.), MEGAFAC F-110, F-120, F-113, F-191, F-812 and F-833 (from Dainippon Ink & Chemicals, Incorporated), EFTOP EF-102, 103, 104, 105, 112, 123A, 123B, 306A, 501, 201 and 204 (from JEMCO Inc.), and FTERGENT F-100 and F-150 (from Neos Co., Ltd.).

It is also preferred to use a cationic surfactant as dispersing agent. Examples of fluoroalkyl-containing cationic surfactants for use in the present invention include aliphatic primary, secondary and tertiary amic acids each having a fluoroalkyl group; aliphatic quaternary ammonium salts such as perfluoroalkyl ($C_6$–$C_{10}$) sulfonamide propyltrimethylammonium salts; benzalkonium salts; benzethonium chloride; pyridinium salts; and imidazolinium salts. Such fluoroalkyl-containing cationic surfactants are commercially available, for example, under the trade names of SURFLON S-121 (from Asahi Glass Co., LTD.), FLUORAD FC-135 (from Sumitomo 3M Limited), UNIDYNE DS-202 (from Daikin Industries, LTD.), MEGAFAC F-150, and F-824 (from Dainippon Ink & Chemicals, Incorporated), EFTOP EF-132 (from JEMCO Inc.), and FTERGENT F-300 (from Neos Co., Ltd.).

In addition, water-insoluble inorganic compounds such as tricalcium phosphate, calcium carbonate, titanium oxide, colloidal silica, and hydroxyapatite can be also used as the dispersing agent.

For further stabilizing the primary particles in the dispersion, a polymeric protective colloid can be used. Examples of the polymeric protective colloid include acids such as acrylic acid, methacrylic acid, α-cyanoacrylic acid, α-cyanomethacrylic acid, itaconic acid, crotonic acid, fumaric acid, maleic acid, and maleic anhydride; hydroxyl-group-containing (meth)acrylic monomers such as β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethylene glycol monoacrylic ester, diethylene glycol monomethacrylic ester, glycerol monoacrylic ester, glycerol monomethacrylic ester, N-methylolacrylamide, and N-methylolmethacrylamide; vinyl alcohol and ethers thereof such as vinyl methyl ether, vinyl ethyl ether, and vinyl propyl ether; esters of vinyl alcohol and a carboxyl-group-containing compound, such as vinyl acetate, vinyl propionate, and vinyl butyrate; acrylamide, methacrylamide, diacetone acrylamide, and methylol compounds thereof; acid chlorides such as acryloyl chloride, and methacryloyl chloride; homopolymers or copolymers of a compound having a nitrogen atom or heterocyclic ring thereof such as vinylpyridine, vinylpyrrolidone, vinylimidazole, and ethyleneimine; polyoxyethylene compounds such as polyoxyethylene, polyoxypropylene, polyoxyethylene alkyl amine, polyoxypropylene alkyl amine, polyoxyethylene alkyl amide, polyoxypropylene alkyl amide, polyoxyethylene nonyl phenyl ether, polyoxyethylene lauryl phenyl ether, polyoxyethylene stearyl phenyl ester, and polyoxyethylene nonyl phenyl ester; and cellulose derivatives such as methyl cellulose, hydroxyethyl cellulose, and hydroxypropyl cellulose.

To decrease the viscosity of the toner composition obtained, a solvent that can solve the urea-modified polyester resin (i) and/or the polyester prepolymer (A) is preferably used. Such solvents for use herein are preferably volatile and have a boiling point of lower than 100° C. for easier removal from toner particles. Such solvents include, but are not limited to, toluene, xylenes, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, and methyl isobutyl ketone. Each of these solvents can be used alone or in combination. Among them, preferred solvents are toluene, xylene, and other aromatic solvents, methylene chloride, 1,2-dichloroethane, chloroform, carbon tetrachloride, and other halogenated hydrocarbons.

The toner of the present invention is obtained by removing the solvent from the dispersion obtained as described hereinabove. In order to remove this solvent, the temperature of the whole system may be gradually raised, and the solvent in liquid drops completely removed by evaporation. The organic solvent can also be removed by spraying the dispersion into a dry atmosphere to completely remove a water-insoluble organic solvent in the droplets of the dispersion to form fine toner particles. In this case, the aqueous dispersing agent can also be evaporated and removed together with the organic solvent. Examples of the dry atmosphere are heated gases such as air, nitrogen, carbon dioxide, and combustion gas. Especially, it is preferable to use stream of the above-mentioned gases, which is heated at higher temperature than the highest boiling point of the used solvents. A target quality is efficiently attained with a high-speed treatment using, for example, a spray dryer, belt dryer or rotary kiln.

In the present invention, if the particle size distribution of the toner composition in the dispersion is large, and washing and drying are performed while maintaining this particle size distribution, the particle size distribution can be controlled by classifying to obtain a preferred particle size distribution.

The classification of particles can be carried out in the solution using a device such as a cyclone, decanter or centrifuge so as to attain the predetermined particle diameter distribution. Although the classification can be carried out on dried particles after drying, it is more preferred that the classification is carried out in a solution, from the viewpoint of efficiency of the process. The obtained irregular toner particles and coarse particles, as a result of the classification, are sent back to the kneading step so as to recycle. In this case, the fine particles or coarse particles may be in a wet condition.

Although it is preferred to remove as much dispersing agent as possible from the obtained dispersion, it is preferred to perform this operation simultaneously with the classifying operation described previously.

By mixing the toner powder obtained after drying with releasing agent particulates, charge control particulates, fluidizing agent particulates or colorant particulates, or giving a mechanical impulse to the mixed powder, these can be fixed and fused on the powder surface, and the release of these other particles from the surface of the complex particles obtained can be prevented.

Specific methods for applying an impact force are, for example, a method in which the impact force is applied to the mixed particles by using a rotated impeller blade in high speed, a method in which the mixed particles are placed in high-speed flow so as to subject the mixed particles or complex particles to be in a collision course with a suitable collision board. Examples of apparatus therefor include angmill (available from Hosokawa Micron Corporation), a modified I-type mill (available from Nippon Pneumatic MFG., Co., Ltd.) which is reduced pulverizing air pressure, a hybridization system (available from Nara Machine Corporation), Kryptron System (available from Kawasaki Heavy Industries, Ltd.), and an automatic mortar.

In the present invention, when the solvent is removed from the obtained dispersion, it is preferred to remove the solvent from the obtained dispersion while maturing the crosslinking reaction and/or elongation reaction at least by stirring and/or heating this dispersion liquid.

Thus, by stirring and/or heating, and crosslinking or extending the modified polyester resin which can react with compounds having an active hydrogen group, with a compound having an active hydrogen group, the compound having an active hydrogen group in the toner particles can be decreased, and a toner having a storage elastic modulus (G') within specified limits described hereinafter can easily be obtained. In the present invention, fine resin particles are included in the aqueous medium to control the toner particle diameter and the particle size distribution. However, if the aforesaid maturing is inadequate, the crosslinking reaction and/or elongation reaction will be inadequate, and fine resin particles will cover the outer surface of the toner particles. Therefore, even if a washing step is performed later, the compound having an unreacted active hydrogen group remains near the toner surface, and this remaining compound having an active hydrogen group may make charge control unstable.

The toner of the present invention has a storage elastic modulus (G') at a frequency of 1 Hz and a temperature of 180° C., of 500 Pa to 10,500 Pa, and preferably 700 Pa to 7,000 Pa. If this storage elastic modulus (G') is less than 500 Pa, unreacted crosslinking agent or elongation agent remains, and there is a possibility of spoiling the negative charging quality of the toner, or of causing hot offset. If on the other hand it is more than 10,500 Pa, and the toner of the present invention is used in an apparatus which employs a low-temperature fixing system, the lower limit fixing temperature may increase, and the startup time from standby may become long.

If the crosslinking or elongation reaction is inadequate, G' (storage elastic modulus) of this toner at a frequency of 1 Hz and a temperature of 180° C., will be less than 500 Pa, unreacted crosslinking agent or extension agent will remain, and the negative charging quality of the toner will be spoiled. Moreover, at 700 Pa or less, hot offset may also occur. At 10,500 Pa or more, in an Imagio Neo450 manufactured by our company which employs a low-temperature fixing system, the fixing lower limiting temperature rises, and the startup time from standby becomes long.

In the present invention, the reason why the toner is evaluated by the storage elastic modulus (G') at a frequency of 1 Hz and a temperature of 180° C. is because the Inventors discovered that the progress of the crosslinking reaction and/or elongation reaction can be estimated by measuring this storage elastic modulus (G'), and also discovered that, to obtain a toner which satisfies low-temperature fixing and has satisfactory anti-offset qualities, it is important to arrange that this storage elastic modulus (G') is 500 Pa to 10,500 Pa. Specifically, the polymerization degree or the crosslinking degree of the resin in the composition is usually substituted by measuring the viscosity of the resin during polymerization. However, as toner materials other than the resin component are included during manufacture of the toner of the present invention, the method of measuring viscosity during polymerization is not suitable. Moreover, measurement of viscosity cannot be performed in a toner production step in the high temperature region of about 180° C. Therefore, the extent of crosslinking or the elongation reaction of the toner was determined under emulsification conditions and maturation conditions after emulsification, and the extent of the crosslinking or elongation reaction was observed within a certain toner viscoelasticity range.

The viscoelasticity of the toner in the present invention is measured as follows. The stress was set automatically at a frequency of 1 Hz and a temperature of 180° C. using a Rheostress RS50 (Haake Co.), and a parallel plate with a diameter of 20 mm. The toner used was in the form of pellets having a diameter of 20 mm and thickness of 2 mm.

The toner of the present invention preferably has a specific shape and shape distribution of the toner particles. Specifically, it is preferred that the average circularity is 0.90 to 0.96. This toner is effective in forming a reproducible high definition image of proper density. More preferably, the average circularity is 0.940 to 0.955, and the number of particles having a circularity of less than 0.94 is 15% or less. When the average circularity is more than 0.96, in a system employing blade cleaning or the like, poor cleaning of the photoconductor and transfer belt occurs which leads to image soiling. In developing and transfer with a low image surface area, there is little remaining toner and cleaning does not pose a problem, but with a high image surface area, such as that of a color image, or when there are paper feed defects, non-transferred toner which formed an image may remain as transfer residue toner on the photoconductor, and when it builds up, it causes background soiling of the image. Also, the charge roller which contact charges the photoconductor will be contaminated, and it will be impossible for it to manifest its original charging capability. Moreover, in an irregularly-shaped toner having a circularity of less than 0.90 which departs largely from sphericity, satisfactory transfer properties and a high quality image free of dust are not obtained.

The aforesaid circularity may conveniently be measured by passing a suspension containing the particles through an imaging part detection belt on a flat plate, optically detecting a particle image with a CCD camera, and performing an analytical, optical detection. The value obtained by this technique is obtained by dividing a circumferential length of an equivalent circle identical to a projected area by the circumferential length of the actual particles. This value was measured as the average circularity by a flow type particle image analyzer FPIA-2100 (To a Medical Electronics Co., Ltd.). The specific measuring method will be described later.

In the toner of the present invention, it is preferred that the volume average particle diameter (Dv) of the toner particles is 4 μm to 8 μm. In general, it is said that the smaller the diameter of the toner particles, the easier it is to obtain a high-definition image of high resolution, but it is conversely a disadvantage from the viewpoint of transfer properties or cleaning properties. Moreover, when the volume average particle diameter (Dv) is less than 4 μm, in a two-component developer, a toner sticks to the carrier surface when stirred for long periods in the developing apparatus which impairs the charge capability of the carrier, and when used as a one-component developer, filming of toner on the developing roller or sticking of toner to blades or other members used to thin the toner layer, tends to occur.

On the other hand, when the volume average particle diameter (Dv) of toner particles is larger than 8 μm, it becomes difficult to obtain a high-definition image of high resolution, and when toner is added to or removed from the developer, there is often a large variation in the particle diameter of the toner.

In the toner of the present invention, it is preferred that the volume average particle diameter/number average particle diameter of toner particles (Dv/Dn) is 1.10 to 1.25. If this Dv/Dn is more than 1.25, it becomes difficult to obtain a high-definition image of high resolution, and when the toner in the developer is added or removed, there may be a large variation in the particle diameter of the toner. On the other hand, when Dv/Dn is less than 1.10, although this is preferred from the viewpoint of stabilizing the action of the toner and equalizing the charging amount, it may occur that the toner cannot be fully charged and cleaning properties may be impaired.

In the toner of the present invention, it is preferred that the toner particles are elliptic shaped. When the shape of a toner is irregular or compressed and the toner has poor particle fluidity because of its shape, following (1) to (3) problems occur. (1) The toner deposits on the background of images, as a result of insufficient friction charge. (2) It is difficult for such badly shaped toner to precisely and uniformly be placed on very fine latent dot images at developing step. Therefore, such toner generally has poor dot reproducibility. (3) Further, the toner has insufficient transfer efficiency in latent electrostatic transferring system since the irregularly shaped toner is hard to receive electric line of force. Toner particles being substantially spherical have an excessively high fluidity, excessively respond to external force and thereby readily scatter outside of dots during development and transfer procedures. In addition, spherical toner particles easily roll into the space between an image bearing member and a cleaning member, thus inviting cleaning failure.

Figure 1B:
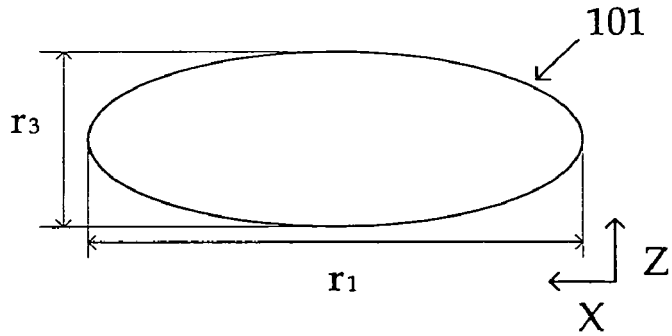
FIGS. 1B and 1C are diagrams showing the major axis $r_1$, the minor axis $r_2$ and the thickness $r_3$ of the elliptic shaped toner particles.
Figure 1C:
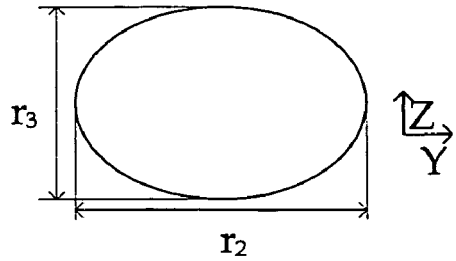

An example of spindle shaped toner particles is shown in FIGS. 1A, 1B and 1C.

The toner having a spindle shape has an appropriately controlled fluidity, can be charged by friction smoothly and thereby avoids toner deposition on the background of images. The toner image can be precisely developed in exact accordance with fine latent dot images and can be efficiently transferred to, for example, a recording medium, thus exhibiting excellent dot reproducibility. The appropriate fluidity of the toner can also prevent scattering of the toner particles during these procedures. In addition, the spindle shaped toner is more resistant to cleaning failures than a spherical toner, since the spherical toner is easily rolled out into the space between a photoconductor and a cleaning member.

In the toner of the present invention, as mentioned above, it is preferred that the form of the toner particles is spindle shaped. More specifically, it is more preferred that they have a spindle shape wherein the ratio ($r_2/r_1$) of the major axis $r_1$ to the minor axis $r_2$ of the toner particles is from 0.5 to 0.8, and the ratio ($r_3/r_2$) of the thickness $r_3$ to the short axis length $r_2$ of the toner particles is from 0.7 to 1.0. Within these limits, the form is a spindle shape which is neither irregular/flat nor spherical, and this shape has the frictional electrostatic quality, dot reproducibility, transfer efficiency, anti-scatter property and cleaning quality of both these shapes.

The major axis $r_1$, minor axis $r_2$ and thickness $r_3$ of the toner particles mean the lengths defined as shown in FIGS. 1B and 1C.

If the ratio ($r_2/r_1$) is less than 0.5, a cleaning property of the toner is high because of less spherical toner particle shape. However, it is insufficient in dot reproducibility and transfer efficiency hence high quality images may not be obtained. If the ratio ($r_3/r_2$) of the thickness $r_3$ and the minor axis $r_2$ is less than 0.7, the form is close to flat, and although there is little scatter as with irregularly-shaped toner, the high transfer rate of spherical toner is not obtained.

If the ratio ($r_2/r_1$) is more than 0.8, cleaning failures may occur specially in an atmosphere of low temperatures and low humidity since the toner particle shape become closer to sphere. Especially when the ratio ($r_3/r_2$) is 1.0, a shape of the toner becomes almost rotator having the main axis as a rotating axis.

The major axis $r_1$, the minor axis $r_2$ and thickness $r_3$ of the toner particles were measured by taking photographs and observing from different viewing angles with a scanning electron microscope (SEM).

Any conventional or known dyes and pigments can be used as the colorant of the toner of the present invention. Such dyes and pigments include, but are not limited to, carbon black, nigrosine dyes, black iron oxide, Naphthol Yellow S, Hansa Yellow (10G, 5G, and G), cadmium yellow, yellow iron oxide, yellow ochre, chrome yellow, Titan Yellow, Polyazo Yellow, Oil Yellow, Hansa Yellow (GR, A, RN, and R), Pigment Yellow L, Benzidine Yellow (G, GR), Permanent Yellow (NCG), Vulcan Fast Yellow (5G, R), Tartrazine Lake, Quinoline Yellow Lake, Anthragen Yellow BGL, isoindolinone yellow, red oxide, red lead oxide, red lead, cadmium red, cadmium mercury red, antimony red, Permanent Red 4R, Para Red, Fire Red, p-chloro-o-nitroaniline red, Lithol Fast Scarlet G, Brilliant Fast Scarlet, Brilliant Carmine BS, Permanent Red (F2R, F4R, FRL, FRii, F4RH), Fast Scarlet VD, Vulcan Fast Rubine B, Brilliant Scarlet G, Lithol Rubine GX, Permanent Red F5R, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, eosine lake, Rhodamine Lake B, Rhodamine Lake Y, Alizarine Lake, Thioindigo Red B, Thioindigo Maroon, Oil Red, quinacridone red, Pyrazolone Red, Polyazo Red, Chrome Vermilion, Benzidine Orange, Perynone Orange, Oil Orange, cobalt blue, cerulean blue, Alkali Blue Lake, Peacock Blue Lake, Victoria Blue Lake, metal-free phthalocyanine blue, Phthalocyanine Blue, Fast Sky Blue, Indanthrene Blue (RS, BC), indigo, ultramarine, Prussian blue, Anthraquinone Blue, Fast Violet B, Methyl Violet Lake, cobalt violet, manganese violet, dioxazine violet, Anthraquinone Violet, chrome green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc white, and lithopone, and mixtures thereof.

The content of the colorant is generally from 1% by weight to 15% by weight, and preferably from 3% by weight to 10% by weight, relative to the toner.

A colorant for use in the present invention may be a master batch prepared by mixing and kneading a pigment with a resin. Examples of binder resins for use in the production of the master batch or in kneading with the master batch are, in addition to the aforementioned modified and unmodified polyester resins, polystyrenes, poly-p-chlorostyrenes, polyvinyltoluenes, and other polymers of styrene and substituted styrenes; styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl $\alpha$-chloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers, styrene-maleic ester copolymers, and other styrenic copolymers; poly(methyl methacrylate), poly(butyl methacrylate), poly(vinyl chloride), poly(vinyl acetate), polyethylenes, polypropylenes, polyesters, epoxy resins, epoxy polyol resins, polyurethanes, polyamides, poly(vinyl butyral), poly(acrylic acid) resins, rosin, modified rosin, terpene resins, aliphatic or alicyclic hydrocarbon resins, aromatic petroleum resins, chlorinated paraffins, and paraffin waxes. Each of these resins can be used alone or in combination.

The master batch can be prepared by mixing and kneading a resin for master batch and the colorant under high shearing force. In this procedure, an organic solvent can be used for higher interaction between the colorant and the resin. In addition, a "flushing process" is preferably employed, in which an aqueous paste containing the colorant and water is mixed and kneaded with an organic solvent to thereby transfer the colorant to the resin component, and the water and organic solvent are then removed. According to this process, a wet cake of the colorant can be used as intact without drying. A high shearing dispersing apparatus such as a three-roll mill can be preferably used in mixing and kneading.

The toner of the present invention can also be made to contain a wax together with the binder resin and colorant. Such waxes include known waxes including polyolefin waxes such as polyethylene waxes and polypropylene waxes; long-chain hydrocarbon waxes such as paraffin waxes and Sasol waxes; and carbonyl-containing waxes. Among them, preferred waxes are carbonyl-containing waxes. Such carbonyl-containing waxes include, for example, polyalkanoic acid esters such as carnauba wax, montan wax, trimethylolpropane tribehenate, pentaerythritol tetrabehenate, pentaerythritol diacetate dibehenate, glycerol tribehenate, and 1,18-octadecanediol distearate; polyalkanol esters such as tristearyl trimellitate, and distearyl maleate; polyalkanoic acid amides such as ethylenediaminedibehenamide; polyalkylamides such as tristearylamide trimellitate; and dialkyl ketones such as distearyl ketone. Among these carbonyl-containing waxes, preferred are polyalkanoic acid esters.

The wax generally has a melting point of from 40° C. to 160° C., preferably from 50° C. to 120° C., and more preferably from 60° C. to 90° C. The wax with a melting point of lower than 40° C. may adversely affect the storage stability at high temperatures. In contrast, the wax with a melting point of higher than 160° C. may often invite cold offset upon image fixing at low temperatures. The wax has a melt viscosity of preferably from 5 cps to 1,000 cps, and more preferably from 10 cps to 100 cps as measured at a temperature 20° C. higher than its melting point. A wax with a melt viscosity more than 1,000 cps may not satisfactorily contribute to improve hot offset resistance and image-fixing properties at low temperatures. The content of the wax in the toner is generally from 0% by weight to 40% by weight, and preferably from 3% by weight to 30% by weight.

The toner may further contain a charge control agent according to necessity. Such charge control agents include known charge control agents, for example, nigrosine dyes, triphenylmethane dyes, chromium-containing metal complex dyes, molybdic acid chelate pigments, rhodamine dyes, alkoxyamines, quaternary ammonium salts including fluorine-modified quaternary ammonium salts, alkylamides, elementary substance or compounds of phosphorus, elementary substance or compounds of tungsten, fluorine-containing active agents, metal salts of salicylic acid, and metal salts of salicylic acid derivatives. Examples of the charge control agents include commercially available products under the trade names of BONTRON 03 (Nigrosine dyes), BONTRON P-51 (quaternary ammonium salt), BONTRON S-34 (metal-containing azo dye), BONTRON E-82 (metal complex of oxynaphthoic acid), BONTRON E-84 (metal complex of salicylic acid), and BONTRON E-89 (phenolic condensation product) available from Orient Chemical Industries Co., Ltd.; TP-302 and TP-415 (molybdenum complex of quaternary ammonium salt) available from Hodogaya Chemical Co., Ltd.; COPY CHARGE PSY VP2038 (quaternary ammonium salt), COPY BLUE PR (triphenylmethane derivative), COPY CHARGE NEG VP2036 and COPY CHARGE NX VP434 (quaternary ammonium salt) available from Hoechst AG; LRA-901, and LR-147 (boron complex) available from Japan Carlit Co., Ltd.; as well as copper phthalocyanine pigments, perylene pigments, quinacridone pigments, azo pigments, and polymeric compounds having a functional group such as sulfonic group, carboxyl group, and quaternary ammonium salt.

The amount of the charge control agent is not specifically limited, can be set depending on the type of the binder resin, additives, if any, used according to necessity, and the method for preparing the toner including a dispersing process. Its amount is preferably from 0.1 parts by weight to 10 parts by weight, and more preferably from 0.2 parts by weight to 5 parts by weight relative to 100 parts by weight of the binder resin. If the amount is more than 10 parts by weight, the toner may have an excessively high charge, the charge control agent may not sufficiently play its role, the developer may have increased electrostatic attraction to a development roller, may have decreased fluidity or may induce a decreased density of images. The charge control agent may be incorporated into the toner, for example, (1) by melting and kneading with the master batch and the resin to thereby dissolve or disperse the charge control agent therein, (2) by directly added to the organic solvent during the dispersion procedure, or (3) by immobilizing to the surface of prepared toner particles.

Additives may be added to the toner of the present invention to enhance the fluidity, or developing quality and charging quality. Inorganic fine particles are preferably used as the external additive. The inorganic fine particles have a primary particle diameter of preferably from 5 nm to 2 μm, and more preferably from 5 nm to 500 nm and have a specific surface area as determined by the BET method of preferably from 20 $m^2/g$ to 500 $m^2/g$. The amount of the inorganic fine particles is preferably from 0.01% by weight to 5% by weight, and more preferably from 0.01% by weight to 2% by weight of the toner.

Examples of the inorganic fine particles are silica, alumina, titanium oxide, barium titanate, magnesium titanate, calcium titanate, strontium titanate, zinc oxide, tin oxide, silica sand, clay, mica, wollastonite, diatomaceous earth, chromium oxide, cerium oxide, iron oxide red, antimony trioxide, magnesium oxide, zirconium oxide, barium sulfate, barium carbonate, calcium carbonate, silicon carbide, and silicon nitride.

Other examples of the external additive are polymer particles of thermosetting resins obtained by soap-free emulsion polymerization, suspension polymerization or dispersion polymerization, such as polystyrene, copolymers of methacrylic esters or acrylic esters; polycondensed products of silicone resins, benzoguanamine resins, nylon resins.

A surface treatment is suitably performed on these external additives such as fluidizing agent to improve hydrophobic property so that fluidity and charging ability are inhibited from being impaired even in a high humidity atmosphere. Suitable surface treatment agents are, for example, a silane coupling agent, a sililating agent, a silane coupling agent having a fluorinated alkyl group, an organic titanate coupling agent, an aluminium coupling agent, a silicone oil, and a modified silicone oil.

A cleaning agent (cleaning improver) may also be added in order to remove the developer remained on a photoconductor or on a primary transfer member after transfer. Suitable cleaning agents are, for example, metal salts of stearic acid and other fatty acids such as zinc stearate, and calcium stearate; and poly(methyl methacrylate) fine particles, polystyrene fine particles, and other fine polymer particles prepared by, for example, soap-free emulsion polymerization. Such fine polymer particles preferably have a relatively narrow particle distribution and a volume-average particle diameter of 0.01 μm to 1 μm.

The toner of the present invention can be used in combination with a magnetic carrier in a two-component developer. The amount of the toner in the developer is preferably from 1 to 10 parts by weight relative to 100 parts by weight of the carrier. Such magnetic carriers include, for example, conventional magnetic particles with a particle diameter of from 20 μm to 200 μm, made of iron, ferrite, magnetite, and magnetic resins.

Coating materials for use herein include, but are not limited to, amine resins such as urea-formaldehyde resins, melamine resins, benzoguanamine resins, urea resins, polyamide resins, and epoxy resins; polyvinyl and polyvinylidene resins such as acrylic resins, poly(methyl methacrylate) resins, polyacrylonitrile resins, poly(vinyl acetate) resins, poly(vinyl alcohol) resins, poly(vinyl butyral) resins; polystyrene resins, styrene-acrylic copolymer resins, and other styrenic resins; poly(vinyl chloride) and other halogenated olefin resins; poly(ethylene terephthalate) resins, poly(butylene terephthalate) resins, and other polyester resins; polycarbonate resins; polyethylene resins; poly(vinyl fluoride) resins, poly(vinylidene fluoride) resins, polytrifluoroethylene resins, polyhexafluoropropylene resins, copolymers of vinylidene fluoride and acrylic monomer, vinylidene fluoride-vinyl fluoride copolymers, terpolymers of tetrafluoroethylene, vinylidene fluoride, and a non-fluorinated monomer, and other fluoroterpolymers; and silicone resins.

The resin for use in the coating material may further comprise a conductive powder according to necessity. Such conductive powders include, for example, powders of metals, carbon black, titanium oxide, tin oxide, and zinc oxide. These conductive powders preferably have an average particle diameter of 1 μm or less. If the average particle diameter is more than 1 μm, the electric resistance of the developer may not sufficiently be controlled.

The toner of the present invention can also be used as a one-component magnetic or non-magnetic toner without using a carrier.

(Developer)

The developer agent of the present invention contains at least the toner of the present invention, and may also contain other components selected as appropriate such as a carrier. This developer may be a one-component developer or a two-component developer, but when used for a high speed printer corresponding to the improvement in information processing speed in recent years, the aforesaid two-component developer is preferred from the viewpoint of longer life.

In the case of a one-component developer using the aforesaid toner of the present invention, even if toner is added or removed so as to control the amount thereof in a process of developing, there is little change in the particle diameter of the toner on the whole, no filming of the toner on the developing roller and no sticking of the toner to members such as a blade for thinning the toner layer. In long-term use of the developing apparatus (stirring), a good, stable developing quality and image are obtained. In the case of a two-component developer using the aforesaid toner of the present invention, even if toner is added or removed to control the amount thereof in a process of developing over a long period of time, there is little change in the particle diameter of the toner in the developer. Also, even after stirring for long periods in the developing apparatus, a good, stable developing quality is obtained.

The aforesaid carrier is not particularly limited and may be suitably selected according to the purpose, but it preferably comprises a core material and a resin layer covering this core material.

The aforesaid core material is not particularly limited and may be suitably selected according to the purpose, but for example a manganese-strontium (Mn—Sr) material or manganese-magnesium (Mn—Mg) material of 50 emu/g to 90 emu/g, is preferred, and from the viewpoint of ensuring image density, a highly magnetic material such as iron powder (100 emu/g or more) and magnetite (75 emu/g to 120 emu/g), is preferred. Moreover, from the viewpoint of weakening contact with the photoconductor when toner forms a brush thereupon which is an advantage for obtaining high definition, a weakly magnetic material such as copper-zinc (Cu—Zn) (30 emu/g to 80 emu/g), is preferred. One of these may be used alone, or two or more may be used in combination.

In the case of a magnetic carrier, the magnetic material is not particularly limited and may be suitably selected from those known in the art according to the purpose, for example, iron powder, magnetite and ferrite. Among these, white materials are preferred in respect of color tone.

The particle diameter of the aforesaid core material is from 10 μm to 200 μm, preferably from 20 μm to 200 μm, and more preferably from 40 μm to 100 μm in terms of an average particle diameter (volume average particle diameter (D50)).

If the average particle diameter (volume average particle diameter (D50)) is less than 10 μm, in the distribution of carrier particles, fine particulates may increase, the magnetization per particle may fall and carrier scattering may occur. If it is larger than 200 μm, the specific surface area will fall, and scattering of toner may occur. In full color with many solid image, the reproduction of the solid image may worsen.

The aforesaid resin layer is not particularly limited and may be suitably selected according to the purpose from resins known in the art. Examples are amino resins, polyvinyl resins, polystyrene resins, halogenated olefin resins, polyester resins, polycarbonate resins, polyethylene resins, polyfluorinated vinyl resins, polyfluorinated vinylidene resins, polytrifluoroethylene resins, polyhexafluoropropylene resins, copolymers of vinylidene fluoride with an acrylic monomer, copolymers of vinylidene fluoride with vinyl fluoride, fluoroterpolymers such as a terpolymer of tetrafluoroethylene, vinylidene fluoride and a non-fluorinated monomer, and silicone resins. One of these may be used alone, or two or more may be used in combination.

Examples of amino resins are a urea-formaldehyde resin, a melamine resin, a benzoguanamine resin, a urea resin, a polyamide resin, an epoxy resin and the like. Examples of polyvinyl resins are an acrylic resin, a polymethylmethacrylate resin, a polyacrylonitrile resin, a polyvinyl acetate resin, a polyvinyl alcohol resin, a polyvinyl butyral resin and the like. Examples of polystyrene resins are a polystyrene resin, a styrene-acrylic copolymer resin and the like. An example of a halogenated olefin resin is polyvinyl chloride and the like. Examples of polyester resins are a polyethylene terephthalate resin, a polybutylene terephthalate resin and the like.

The aforesaid resin layer may contain an electrically conducting powder if required. Such conductive powders include, for example, powders of metals, carbon black, titanium oxide, tin oxide, zinc oxide and the like. These conductive powders preferably have an average particle diameter of 1 μm or less. If the average particle diameter is larger than 1 μm, the electric resistance of the developer may not sufficiently be controlled.

The resin layer may be formed for example by dissolving the aforesaid silicone resin in a solvent to prepare a coating solution, applying this coating solution to the surface of the aforesaid core material uniformly by an application method known in the art, drying, and baking. Examples of the application method are the immersion method, the spray method, the brush method and the like.

The aforesaid solvent is not particularly limited and may be suitably selected according to the purpose, examples being toluene, xylene, methylethyl ketone, methylisobutyl ketone, cellusolve acetate and the like.

The aforesaid baking is not particularly limited and may be external heating or internal heating, for example, a method using a fixed type electric furnace, flow type electric furnace, rotary type electric furnace or burner furnace, or a method using microwaves.

The amount of the aforesaid resin layer in the carrier is preferably 0.01% by mass to 5.0% by mass.

If the amount is less than 0.01% by mass, it may be impossible to form a uniform resin layer on the surface of the core material, whereas if it is more than 5.0% by mass, the resin layer will become too thick, cohesion of carrier will occur, and uniform carrier particles may not be obtained.

When the aforesaid developer is a two-component developer, the carrier content of this two-component developer is not particularly limited and may be suitably selected according to the purpose, but for example, it is preferably 90% by mass to 98% by mass, and more preferably 93% by mass to 97% by mass.

The developer of the present invention contains the toner of the present invention, so it excels in anti-offset quality, has both outstanding heat-resistant storage quality and low-temperature fixability, and has a sharp charge distribution, thus allowing a clear, high-definition image to be formed.

The developer of the present invention can be used to form images by various electrophotographic methods known in the art, such as the magnetic one-component developing method, the non-magnetic one-component developing method, and the two-component developing method. It is particularly suitable for the toner container, process cartridge, image-forming apparatus and image-forming method of the present invention.

(Toner Container)

The toner container of the present invention contains the toner or the developer of the present invention in a container.

The container is not particularly limited and may be suitably selected from among those known in the art, for example, comprising a toner container body and a cap.

The toner container body is not particularly limited as to size, shape, construction and material, and may be selected according to the purpose, but for example, the shape may conveniently be cylindrical. It is particularly preferred that spiral-like protrusions and depressions are formed on the inner circumferential surface, so that the toner in the container can shift to the outlet side by rotating the container, and that part or all of this spiral part has a bellows function.

The material of the aforesaid toner container body is not particularly limited, but it is preferably a material having a good dimensional precision. Examples are resins, such as polyester resin, polyethylene resin, polypropylene resin, polystyrene resin, polyvinyl chloride resin, polyacrylic acid, polycarbonate resin, ABS resin and polyacetal resin.

The toner container of the present invention is easy to transport, and very easy to handle. It can be attached to or removed from the process cartridge or image-forming apparatus of the present invention, described later, so that it can be re-filled with toner.

(Process Cartridge)

The process cartridge of the present invention comprises at least a latent electrostatic image carrier, i.e., photoconductor, which bears a latent electrostatic image, and a developing unit configured to develop the latent electrostatic image on this latent electrostatic image carrier using a developer to form a visible image, and other units suitably selected as necessary.

Figure 2:
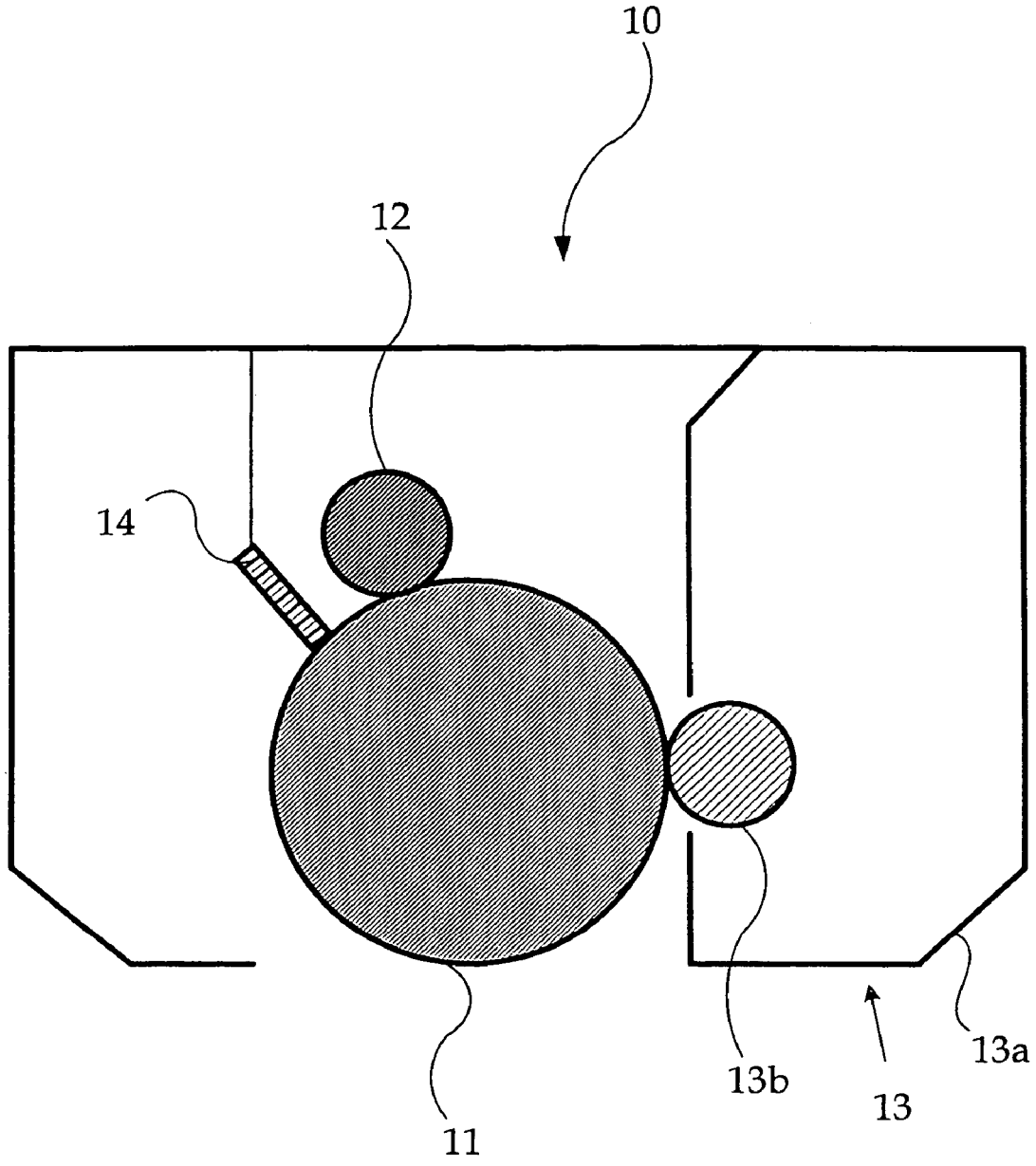
FIG. 2 is a schematic diagram showing one example of process cartridge of the present invention.

FIG. 2 shows one embodiment of the process cartridge according to the present invention. The process cartridge 10 is formed with the photoconductor 11, the charger 12, the developing unit 13, and the cleaning unit 14.

The developing unit 13 comprises at least a developer container 13*a* which houses the toner or developer of the present invention, and a developer carrier 13*b* which bears and transports the toner or developer in the developer container, and may further comprise a layer thickness adjusting member (not shown in FIG. 2) for adjusting the toner layer thickness.

The process cartridge of the present invention can preferably be attached to or removed from various electrophotographic apparatuses, and can preferably be attached to or removed from the electrophotographic apparatus of the present invention, described later.

(Image-Forming Apparatus and Image-Forming Process)

The image-forming apparatus of the present invention comprises a photoconductor, an electrostatic image-forming unit, a developing unit, a transfer unit and a fixing unit, and may further comprise other units, for example, a discharge unit, cleaning unit, recycling unit and control unit if required.

The image-forming process of the present invention comprises a latent electrostatic image-forming step, a developing step, a transfer step and a fixing step, and may further comprise other steps, for example, a discharge step, cleaning step, recycling step and control step if required.

The image-forming process of the present invention can be suitably applied to the image-forming apparatus of the present invention. The latent electrostatic image-forming step can be performed by the latent electrostatic image-forming unit, the developing step can be performed by the developing unit, the transfer step can be performed by the transfer unit, and the fixing step can be performed by the fixing unit. The other steps can be performed by the aforesaid other unit.

-Latent Electrostatic Image-Forming Step and Latent Electrostatic Image-Forming Unit- The aforesaid latent electrostatic image-forming step is a step of forming a latent electrostatic image on the photoconductor.

The photoconductor is not particularly limited as regards material, shape, construction or size, and may be suitably selected from among those known in the art, but its shape may be that of a drum, and its material may be that of an inorganic photoconductor, such as amorphous silicon or selenium, or an organic photoconductor such as polysilane or phthalopolymethane. Among these, amorphous silicon is preferred from the viewpoint of long life.

The latent electrostatic image can be formed for example by uniformly charging the surface of the aforesaid photoconductor, and exposing it imagewise, which may be performed by the aforesaid latent electrostatic image-forming unit.

The latent electrostatic image-forming unit for example comprises at least a charging unit which uniformly charges the surface of the photoconductor, and an exposure unit which exposes the surface of the aforesaid photoconductor imagewise with light.

The charging may for example be performed by applying a voltage to the surface of the photoconductor using the aforesaid charging unit.

The charging unit is not particularly limited and may be suitably selected according to the purpose, examples being contact chargers known in the art such as a conductive or semi-conductive roller, brush, film or rubber blade, and non-contact chargers using corona discharge such as a corotron or scorotron.

The exposure can be performed by exposing the surface of the photoconductor imagewise with light, for example using the aforesaid exposure unit.

The exposure unit is not particularly limited and may be suitably selected according to the purpose provided that it can expose the surface of the photoconductor charged by the aforesaid charger in the same way as the image to be formed, for example an exposure unit such as a copy optical system, a rod lens array system, a laser optical system or a liquid crystal shutter optical system.

In addition, in the present invention, a backlight system may be employed wherein the aforesaid photoconductor is exposed imagewise from its rear surface.

-Developing Step and Developing Unit-

The developing step is a step of develops the aforesaid latent electrostatic image using the toner or the developer of the present invention to form a visible image.

The visible image can be formed for example by applying the toner or the developer of the present invention to the latent electrostatic image and then forming a toner image, which can be performed by the developing unit.

The developing unit is not particularly limited provided that it can develop an image for example by using the toner or the developer of the present invention, and may be suitably selected from among those known in the art. Examples are those which comprise at least a developing part housing the toner or developer of the present invention, and which can supply the toner or developer with contact or without contact to the aforesaid latent electrostatic image, but more preferably it is a developing part provided with a container containing the toner of the present invention.

The developing part may be the dry type or wet type, and may be a monochrome developing part or a multi-color developing part. Examples thereof are parts comprising a stirrer which charge the toner or the developer by friction stirring, and parts comprising a rotatable magnet roller.

In the aforesaid developing part, the toner and the carrier may for example be mixed and stirred together. The toner is thereby charged by friction, and forms a magnetic brush on the surface of the rotating magnet roller. As this magnet roller is arranged near the photoconductor, part of the toner in the magnetic brush formed on the surface of this magnet roller moves to the surface of this photoconductor due to the force of electrical attraction. As a result, the aforesaid latent electrostatic image is developed by this toner, and a visible toner image is formed on the surface of this photoconductor.

The developer housed in the developing part is a developer containing the aforesaid toner of the present invention, and the developer may be a one-component developer or a two-component developer. The toner contained in this developer is the toner of the present invention.

-Transfer Step and Transfer Unit-

The transfer step is a step of transferring the visible image, i.e., toner image, to a recording medium. In a preferred aspect, a first transfer is performed wherein, using an intermediate transfer body, the visible image is transferred to the intermediate transfer body, and a second transfer is then performed wherein this visible image is transferred to a recording medium. In a more preferred aspect, using toner of two or more colors and preferably full color toner, the primary transfer step transfers the toner image to the intermediate transfer body to form a compound transfer image, and the second transfer step transfers this compound transfer image to the recording medium.

The aforesaid transfer can be realized for example by charging the aforesaid photoconductor using a transfer charger, which can be performed by the aforesaid transfer unit. In a preferred aspect, the transfer unit comprises a first transfer unit which transfers the visible image to the intermediate transfer body to form a compound transfer image, and a second transfer unit which transfers this compound transfer image to the recording medium.

The aforesaid intermediate transfer body is not particularly limited and may be suitably selected from transfer bodies known in the art, for example, a transfer belt.

The aforesaid transfer unit (the first transfer unit and the second transfer unit), preferably comprises at least a transfer which charges by releasing the toner image formed on the aforesaid photo conductor to the recording-medium side. There may be one, two or more of the aforesaid transfer units.

The transfer may be a corona transfer unit which functions by corona discharge, a transfer belt, a transfer roller, a pressure transfer roller or an adhesion transfer.

The aforesaid recording medium is not particularly limited and may be suitably selected from among recording media (recording papers) known in the art.

The aforesaid fixing step is a step of fixing the toner image transferred to the recording medium using a fixing unit. This may be carried out for toner of each color transferred to the recording medium, or in one operation when the toners of each color have been laminated.

The fixing unit is not particularly limited and may be suitably selected from heat and pressure means known in the art. Examples of heat and pressure means are a combination of a heat roller and pressure roller, and a combination of a heat roller, pressure roller and endless belt.

The heating by the aforesaid heat and pressure means is preferably heating to from 80° C. to 200° C.

Also, in the present invention, an optical fixer known in the art may be used in addition to or instead of the fixing step and fixing unit, according to the purpose.

The aforesaid discharge step is a step of applying a discharge bias to the aforesaid photoconductor to discharge it, which may be performed by a discharge unit.

The aforesaid discharge unit is not particularly limited and may be suitably selected from discharge means known in the art provided that it can apply a discharge bias to the aforesaid photoconductor, for example, a discharge lamp.

The aforesaid cleaning step is a step of recovering electrophotographic toner remaining on the photoconductor, and may be performed by a cleaning unit.

The aforesaid cleaning unit is not particularly limited and may be suitably selected from cleaning means known in the art provided that it can remove the toner remaining on the photoconductor, for example, a magnetic brush cleaner, electrostatic brush cleaner, magnetic roller cleaner, blade cleaner, brush cleaner or web cleaner.

The recycling step is a step of making the aforesaid developing unit recycle the electrophotographic color toner removed by the aforesaid cleaning step, and may be performed by a recycling unit.

The aforesaid recycling unit is not particularly limited and may be suitably selected from among transport means known in the art.

The aforesaid control step is a step of controlling the aforesaid steps, and may be implemented by a control unit.

The control unit is not particularly limited and may be suitably selected according to the purpose provided that it can control the operation of each of the aforesaid units, for example, a device such as a sequencer or a computer.

One aspect of the image-forming process of the present invention, implemented by the image-forming apparatus of the present invention, will now be described. The image-forming apparatus of the present invention for example comprises a photo conductor drum (hereafter, photoconductor) as the aforesaid latent electrostatic image carrier, a charge roller as the aforesaid charging unit, an exposure apparatus as the aforesaid exposure unit, a developing apparatus as the aforesaid developing unit, an intermediate transfer body, a cleaning apparatus as the aforesaid cleaning unit comprising a cleaning blade, and a discharge lamp as the aforesaid discharge unit.

The aforesaid intermediate transfer object is an endless belt, and is designed so that it can be moved in the direction of the arrow by three rollers which are suspended on its inner side. Some of the three rollers also function as a transfer bias roller which can apply a predetermined transfer bias (primary transfer bias) to the intermediate transfer body. A cleaning apparatus having a cleaning blade is arranged in the vicinity of the intermediate transfer body, and a transfer roller as the aforesaid transfer means which can apply a transfer bias to transfer (secondary transfer) the developed image (toner image) to a transfer paper as final transfer material is arranged opposite to this. Around the intermediate transfer body, corona charge units for giving an electric charge to the toner image on the intermediate transfer body are disposed between a contact part of the photoconductor and intermediate transfer body, and a contact part of the intermediate transfer body and transfer paper, in the rotation direction of the intermediate transfer body.

The developing apparatus comprises a developing belt as the developer carrier, and a black developing unit, yellow developing unit, magenta developing unit and cyan developing unit arranged side by side around this developing belt. The black developing unit has a developer housing part, developer supply roller and developing roller, the yellow developing unit has a developer housing part, developer supply roller and developing roller, the magenta developing unit has a developer housing part, developer supply roller and developing roller, and the cyan developing unit has a developer housing part, developer supply roller and developing roller. The aforesaid developing belt is an endless belt suspended free to rotate on plural belt rollers, and part touches the aforesaid photoconductor.

In the aforesaid image-forming apparatus, for example, the charge roller uniformly charges the photoconductor drum. The exposure unit exposes the photoconducting drum imagewise so as to form a latent electrostatic image. The latent electrostatic image formed on the photoconducting drum is developed by supplying toner from the developing apparatus so as to form a visible image (toner image). This visible image (toner image) is transferred to the intermediate transfer body by a voltage applied from the roller (primary transfer), and is then transferred to the transfer paper (secondary transfer). As a result, a transfer image is formed on the transfer paper. Residual toner on the photoconductor is removed by the aforesaid cleaning apparatus, and the charge on the photoconductor is temporarily removed by the discharge lamp.

The present invention will now be described in further detail, but it will be appreciated that the present invention is not limited thereto. Parts in the examples and comparative examples are parts by weight.

EXAMPLE 1

(1) Preparation of Resin Particulate Dispersion 683 parts water, 15 parts of the sodium salt of methacrylic acid ethylene oxide adduct sulfate ester (Ereminol RS-30, Sanyo Chemical Industries), 83 parts styrene, 83 parts methacrylic acid, 110 parts butyl acrylate and 1 part of ammonium persulfate were introduced into a reaction vessel provided with a stirring rod and thermometer, and stirred at 400 rpm for 15 minutes. A white emulsion was thereby obtained. This was heated to raise the temperature in the system to 75° C., and reacted for 5 hours. Next, 30 parts of 1% aqueous ammonium persulfate solution was added, and reacted at 75° C. for 5 hours to obtain an aqueous dispersion of a vinyl resin (styrene-methacrylic acid-butyl acrylate-sodium salt of methacrylic acid ethylene oxide adduct sulfate ester copolymer) [Resin Particulate Dispersion 1]. The weight average particle diameter of [Resin Particulate Dispersion 1] measured by LA-920 was 60 nm. Some of the [Resin Particulate Dispersion 1] was dried, and the resin content was isolated.

(2) Preparation of Aqueous Media 990 parts water, 83 parts of [Resin Particulate Dispersion 1], 37 parts of a 48.5% aqueous solution of dodecyl diphenylether disulfonic acid sodium, (Ereminol MON-7: Sanyo Chemical Industries) and 90 parts ethyl acetate were mixed and stirred to obtain a white emulsion. This was taken as [Aqueous Phase 1].

(3) Synthesis of Low Molecular Weight Polyester 1

229 parts bisphenol A ethylene oxide bimolar adduct, 529 parts bisphenol A propylene oxide trimolar adduct, 208 parts terephthalic acid, 46 parts adipic acid and 2 parts of dibutyltin oxide were introduced into a reaction vessel fitted with a condenser tube, stirrer and nitrogen inlet tube, and reacted at 230° C. under normal pressure for 8 hours. After continuing the reaction under a reduced pressure of from 10 mmHg to 15 mmHg for 5 hours, 44 parts of anhydrous trimellitic acid was introduced into the reaction vessel, and reacted at 180° C. under normal pressure for 2 hours to obtain [Low Molecular Weight Polyester 1] as a non-modified polyester resin (ii). [Low Molecular Weight Polyester 1] had a number average molecular weight of 2500, weight average molecular weight of 6700, Tg of 43° C. and acid value of 25.

(4) Synthesis of Intermediate Polyester and Prepolymer 682 parts of bisphenol A ethylene oxide bimolar adduct, 81 parts of bisphenol A propylene oxide trimolar adduct, 283 parts terephthalic acid, 22 parts anhydrous trimellitic acid and 2 parts of dibutyl tin oxide were introduced into a reaction vessel provided with a condenser tube, stirrer and nitrogen inlet tube, and reacted at 230° C. under normal pressure for 8 hours. After reaction under reduced pressure of from 10 mmHg to 15 mmHg for 5 hours, [Intermediate Polyester 1] was obtained.

[Intermediate Polyester 1] had a number average molecular weight of 2100, weight average molecular weight of 9500, Tg of 55° C., acid value of 0.5 and hydroxyl value of 51.

Next, 410 parts of [Intermediate Polyester 1], 89 parts of isofluorone diisocyanate and 500 parts ethyl acetate were introduced into a reaction vessel provided with a condenser tube, stirrer and nitrogen inlet tube, and reacted at 100° C. for 5 hours to obtain a [Prepolymer 1] as the modified polyester resin (i) capable of reacting with a compound having an active hydrogen group. The isocyanate weight % of free isocyanate of [Prepolymer 1] was 1.53%.

(5) Synthesis of Ketimine 170 parts isofluorone diamine and 75 parts methyl ethyl ketone were introduced into a reaction vessel provided with a stirring rod and thermometer, and the reaction was performed at 50° C. for 5 hours to obtain [Ketimine Compound 1] as the compound having an active hydrogen group. The amine value of [Ketimine Compound 1] was 418.

(6) Synthesis of Master Batch 1200 parts water, 800 parts carbon black (Printex 35, Deksa) [DBP oil absorption=42 ml/100 mg, pH=9.5] and 1200 parts polyester resin were added, and mixed by a Henschel mixer (Mitsui Mining Co., Ltd.). The mixture was kneaded at 150° C. for 30 minutes using 2 rollers, roll-cooled, and crushed by a pulverizer to obtain [Master batch 1].

(7) Preparation of Oil Phase having a Toner Composition Dispersed therein 378 parts of [Low Molecular Weight Polyester 1], 110 parts Carnauba Wax, 22 parts CCA (salicylic-acid metal complex E-84: Orient Chemical Industries, Ltd.) and 947 parts ethyl acetate were introduced into a vessel provided with a stirring rod and thermometer, and the temperature therein was raised to 80° C. with stirring. After holding the temperature at 80° C. for 5 hours, it was cooled to 30° C. in 1 hour. Subsequently, 500 parts of [Master Batch 1] and 500 parts ethyl acetate were introduced into the vessel, and mixed for 1 hour to obtain [Materials Solution 1].

1324 parts of [Materials Solution 1] was transferred to a vessel, and carbon black and Wax were dispersed under the conditions of filling to 80% by volume with 0.5 mm zirconia beads at a liquid transfer rate of 1 kg/hr and disk peripheral velocity of 6 m/sec, and three passes were made using a bead mill (ultra bead mill, Imex). Next, 1324 parts of a 65% ethyl acetate solution of [Low Molecular Weight Polyester 1] was added, and one pass was made with a bead mill under the aforesaid conditions to obtain [Paint and Wax Dispersion 1]. The solids concentration (130° C., 30 minutes) of [Paint and Wax Dispersion 1] was 50%.

[Toner 1] was obtained by the following procedure using the aforesaid materials.

(8) Emulsification→Maturation (Crosslinking Agent Reaction and/or Elongation Reaction in Aqueous Media)→Solvent Degreasing Agent 749 parts of [Paint and Wax Dispersion 1], 115 parts of [Prepolymer 1] and 2.9 parts of [Ketimine Compound 1] were introduced into a vessel and mixed at 5,000 rpm for 1 minute by a TK homomixer (Tokushu Kika Kogyo Co., Ltd.), 1,200 parts of [Aqueous Phase 1] were added to the vessel, and the mixture was mixed at a rotation speed of 13,000 rpm for 20 minutes to obtain [Emulsion Slurry 1].

[Emulsion Slurry 1] was supplied to a vessel provided with a paddle agitator and thermometer, and matured under the conditions of 200 rpm and 28° C. for 90 minutes. Next, after solvent degreasing at 30° C. for 8 hours, [Dispersion Slurry 1] was obtained. [Dispersion Slurry 1] had a volume average particle diameter of 6.01 μm, and number average particle diameter of 5.75 μm (measured by a Multisizer II, Beckman Coulter, Inc.).

(9) Washing→Drying

After filtering 100 parts of [Dispersion Slurry 1] under reduced pressure:

(1): 100 parts of ion exchange water was added to the filter cake, mixed by a TK homomixer available from Tokushu Kika Kogyo Co., Ltd. (rotation speed 12,000 rpm for 10 minutes), and filtered.

(2): 100 parts of 10% hydrochloric acid was added to the filter cake of (1), mixed by the TK homomixer (rotation speed 12,000 rpm for 10 minutes), and filtered.

(3): 300 parts of ion exchange water at 25° C. was added to the filter cake of (2), mixed by the TK homomixer (rotation speed 12,000 rpm for 10 minutes), and filtered twice to obtain a Filter Cake 1.

[Filter Cake 1] was dried at 45° C. for 48 hours by a circulating air dryer, and sieved to obtain [Toner 1] of 75 micrometer mesh.

EXAMPLE 2

(1) Emulsification→Maturation (Crosslinking Agent Reaction and/or Elongation Reaction in Aqueous Media)→Solvent Degreasing Agent In the same way as in Example 1, [Emulsion Slurry 1] was supplied to a vessel provided with a paddle agitator and thermometer, and matured for 30 minutes under the conditions of 200 rpm and 32° C. Next, after solvent degreasing at 30° C. for 8 hours, [Dispersion Slurry 2] was obtained. [Dispersion Slurry 2] had a volume average particle diameter of 5.56 μm, and number average particle diameter of 5.19 μm (measured by a Multisizer II, Beckman Coulter, Inc.).

(2) Washing→Drying

In the same way as in Example 1, washing, filtering and drying were performed to obtain [Filter Cake 2].

[Filter Cake 2] was dried at 45° C. for 48 hours with a circulating air dryer, and sieved to obtain [Toner 2] of 75 micrometer mesh.

EXAMPLE 3

(1) Emulsification→Maturation (Crosslinking Agent Reaction and/or Elongation Reaction in Aqueous Media)→Solvent Degreasing Agent In the same way as in Example 1, [Emulsion Slurry 1] was supplied to a vessel provided with a paddle agitator and thermometer, and matured for 4 hours under the conditions of 180 rpm and 25° C. Next, after solvent degreasing at 30° C. for 8 hours, [Dispersion Slurry 3] was obtained. [Dispersion Slurry 3] had a volume average particle diameter of 6.22 μm, and number average particle diameter of 5.90 μm (measured by a Multisizer II, Beckman Coulter, Inc.).

(2) Washing→Drying

In the same way as in Example 1, washing, filtering and drying were performed to obtain [Filter Cake 3].

[Filter Cake 3] was dried at 45° C. for 48 hours with a circulating air dryer, and sieved to obtain [Toner 3] of 75 micrometer mesh.

EXAMPLE 4

In the same way as in Example 1, [Emulsion Slurry 1] was supplied to a vessel provided with a paddle agitator and thermometer, and matured for 2 hours under the conditions of 180 rpm and 27° C. Next, after solvent degreasing at 30° C. for 8 hours, [Dispersion Slurry 4] was obtained. [Dispersion Slurry 4] had a volume average particle diameter of 6.48 μm, and number average particle diameter of 5.77 μm (measured by a Multisizer II, Beckman Coulter, Inc.).

(2) Washing→Drying

In the same way as in Example 1, washing, filtering and drying were performed to obtain [Filter Cake 4].

[Filter Cake 4] was dried at 45° C. for 48 hours with a circulating air dryer, and sieved to obtain [Toner 4] of 75 micrometer mesh.

EXAMPLE 5

753 parts of [Paint and Wax Dispersion 1], 154 parts of [Prepolymer 1] and 3.8 parts of [Ketimine Compound 1] were introduced into a vessel and mixed at 5,000 rpm for 1 minute by a TK homomixer (Tokushu Kika Kogyo Co., Ltd). 1,200 parts of [Aqueous Phase] was added to the vessel, and mixed at 13,000 rpm for 20 minutes by a TK homomixer to obtain [Emulsion Slurry 2]. [Toner 5] was obtained in an identical way to that of Example 1, except that the above [Emulsion Slurry 2] was used instead of [Emulsion Slurry 1] of Example 1.

EXAMPLE 6

(1) Synthesis of Low Molecular Weight Polyester 2

196 parts bisphenol A propylene oxide bimolar adduct, 553 parts bisphenol A ethylene oxide bimolar adduct, 210 parts terephthalic acid, 79 parts adipic acid and 2 parts of dibutyltin oxide were introduced into a reaction vessel fitted with a condenser tube, stirrer and nitrogen inlet tube, and reacted at 230° C. under normal pressure for 8 hours. After continuing the reaction under a reduced pressure of from 10 mmHg to 15 mmHg for 5 hours, 26 parts of anhydrous trimellitic acid was introduced into the reaction vessel, and reacted at 180° C. under normal pressure for 2 hours to obtain [Low Molecular Weight Polyester 2]. [Low Molecular Weight Polyester 2] had a number average molecular weight of 2400, weight average molecular weight of 6200, Tg of 43° C. and acid value of 15.

(2) [Emulsion Slurry 3] was obtained in an identical way to that of Example 1, using [Low Molecular Weight Polyester 2] instead of [Low Molecular Weight 1] of Example 1. [Emulsion Slurry 3] was supplied to a vessel provided with a paddle agitator and thermometer, and matured under the conditions of 230 rpm and 25° C. for 75 minutes. [Toner 6] was obtained in an identical way to that of Example 1, except that the removal of the solvent was performed at 30° C. for 8 hours.

EXAMPLE 7

In the same way as in Example 6, [Emulsion Slurry 3] was supplied to a vessel provided with a paddle agitator and thermometer, and matured for 60 minutes under the conditions of 230 rpm and 28° C. Next, after removing the solvent at 30° C. for 8 hours, [Dispersion Slurry 7] was obtained. [Dispersion Slurry 7] had a volume average particle diameter of 6.67 μm, and number average particle diameter of 5.47 μm (measured by a Multisizer II, Beckman Coulter, Inc.).

(2) Washing→Drying

In the same way as in Example 1, washing, filtering and drying were performed to obtain [Filter Cake 7].

[Filter Cake 7] was dried at 45° C. for 48 hours with a circulating air dryer, and sieved to obtain [Toner 7] of 75 micrometer mesh.

COMPARATIVE EXAMPLE 1

451 g of 0.1 M-$Na_3PO_4$ solution was introduced into 709 g ion exchange water, heated to 60° C., and stirred at 12,000 rpm using a TK homomixer which was available from Tokushu Kika Kogyo Co., Ltd. 68 g of 1.0 M-$CaCl_2$ solution was gradually added to this to obtain an aqueous medium containing $Ca_3(PO_4)_2$. 170 g styrene, 30 g 2-ethylhexyl acrylate, 10 g of Regal 400R available from Cabot Corporation, 60 g paraffin wax (s.p. 70° C.), 5 g of di-tert-butylsalicylic acid metallic compound and 10 g of styrene-methacrylic acid copolymer (Mw 50,000, acid value 20 mgKOH/g) were introduced into a TK homomixer, heated to 60° C., and dissolved and dispersed homogeneously at 12,000 rpm. 10 g of a polymerization initiator, 2,2'-azobis (2,4-dimethylvaleronitrile), were dissolved in this to prepare a polymerizing monomer. This polymerizing monomer was introduced into the aforesaid aqueous medium, and stirred by a TK homomixer at 10,000 rpm at 60° C. in a $N_2$ atmosphere for 20 minutes to granulate the polymerizing monomer system. Subsequently, after reacting at 60° C. for 3 hours while stirring with a paddle stirrer blade, the temperature of the liquid was raised to 80° C., and the reaction performed for 10 hours. After the polymerization reaction was complete, the mixture was cooled, and hydrochloric acid was added to dissolve calcium phosphate. The mixture was then filtered, washed and dried to obtain [Toner 8].

COMPARATIVE EXAMPLE 2

(1) Preparation of Wax Particle Aqueous Dispersion 1

28.5 g of Newcol 565C (Nippon Nyukazai Co., Ltd.) and 185.5 g of candelilla wax No. 1 (Cerarica Noda Co., Ltd.) was added to 500 ml of degassed, distilled water in a 1,000 ml 4-necked flask provided with a stirrer, temperature sensor, nitrogen inlet tune and condenser tube while stirring in a current of nitrogen, and the temperature therein was raised.

When the internal temperature had been reached 85° C., 5N aqueous sodium hydroxide solution was added, and the temperature was raised to 75° C. Heating and stirring were continued for 1 hour, and the mixture was cooled to room temperature to obtain [Wax Particle Aqueous Dispersion 1].

(2) Preparation of Colorant Aqueous Dispersion 1

100 g carbon black (trade name: Mogul L, Cabot Corp.) and 25 g of dodecyl sodium sulfate were added to 540 ml distilled water, and after thoroughly stirring, dispersion was performed using a pressurized dispersion unit to obtain [Colorant Dispersion I].

(3) Preparation of Binder Particulate Aqueous Dispersion 480 ml distilled water, 0.6 g dodecyl sodium sulfate, 106.4 g styrene, 43.2 g n-butyl acrylate and 10.4 g methacrylic acid were added to a 1 L four-neck flask provided with a stirrer, condenser tube, temperature sensor and nitrogen inlet tube, and the temperature was raised to 70° C. under a current of nitrogen with stirring. An initiator aqueous solution containing 2.1 g potassium persulfate in 120 ml distilled water was then added, stirring was performed under a current of nitrogen at 70° C. for 3 hours, and after polymerization was complete, the mixture was cooled to room temperature to obtain [High Molecular Weight Binder Resin Particulate Dispersion 1].

2400 ml distilled water, 2.8 g dodecyl sodium sulfate, 620 g styrene, 128 g n-butylacrylate, 52 g methacrylic acid and 27.4 g tert-dodecylmercaptan were added to a 5 L four-neck flask provided with a stirrer, condenser tube, temperature sensor and nitrogen inlet tube, and the temperature was raised to 70° C. under a current of nitrogen with stirring. An initiator aqueous solution containing 11.2 potassium persulfate in 600 ml distilled water was then added, stirring was performed under a current of nitrogen at 70° C. for 3 hours, and after polymerization was complete, the mixture was cooled to room temperature to obtain [Low Molecular Weight Binder Resin Particulate Dispersion 2].

[Toner 9] was obtained using the aforesaid materials by the following procedure.

(4) Synthesis of Toner 47.6 g of [High Molecular Weight Binder Particulate Dispersion 1], 190.5 g of [Low Molecular Weight Binder Particulate Dispersion 2], 7.7 g of [Wax Particle Aqueous Dispersion 1], 26.7 g of [Colorant Dispersion I] and 252.5 ml distilled water were added to a 1 L separable flask provided with a stirrer, condenser tube and temperature sensor, mixing with stirring was performed, and the mixture was adjusted to pH=9.5 using 5N-aqueous sodium hydroxide solution. An aqueous sodium chloride solution containing 50 g of sodium chloride dissolved in 600 ml distilled water, and an aqueous surfactant solution containing 77 ml isopropanol and 10 mg Fluorad FC-170C (Sumitomo 3M: fluorinated non-ionic surfactant) in 10 ml distilled water, were added successively with stirring. The internal temperature was raised to 85° C., the reaction was performed for 6 hours, and the product cooled to room temperature. This reaction solution was adjusted to pH=13 using 5N-aqueous sodium hydroxide solution, filtered, re-suspended in distilled water, filtered and suspended repeatedly, washed, and dried to obtain [Toner 9].

COMPARATIVE EXAMPLE 3

(1) Emulsification→Maturation (Crosslinking Agent Reaction and/or Elongation Reaction in Aqueous Media)→Solvent Degreasing Agent In the same way as in Example 1, [Emulsion Slurry 1] was supplied to a vessel provided with a paddle agitator and thermometer, and matured for 15 minutes under the conditions of 200 rpm and 15° C. Next, after removing the solvent at 30° C. for 8 hours, [Dispersion Slurry 10] was obtained. [Dispersion Slurry 10] had a volume average particle diameter of 5.22 μm, and number average particle diameter of 4.54 μm (measured by a Multisizer II).

(2) Washing→Drying

In the same way as in Example 1, washing, filtering and drying were performed to obtain [Filter Cake 10].

[Filter Cake 10] was dried at 45° C. for 48 hours with a circulating air dryer, and sieved to obtain [Toner 10] of 75 micrometer mesh.

COMPARATIVE EXAMPLE 4

(1) Emulsification→Maturation (Crosslinking Agent Reaction and/or Elongation Reaction in Aqueous Media)→Solvent Degreasing Agent In the same way as in Example 6, [Emulsion Slurry 3] was supplied to a vessel provided with a paddle agitator and thermometer, and matured for 12 hours under the conditions of 230 rpm and 33° C. Next, after removing the solvent at 30° C. for 8 hours, [Dispersion Slurry 7] was obtained. [Dispersion Slurry 7] had a volume average particle diameter of 7.84 μm, and number average particle diameter of 6.03 μm (measured by a Multisizer II).

(2) Washing→Drying

In the same way as in Example 1, washing, filtering and drying were performed to obtain [Filter Cake 11].

[Filter Cake 11] was dried at 45° C. for 48 hours with a circulating air dryer, and sieved to obtain [Toner 11] of 75 micrometer mesh.

COMPARATIVE EXAMPLE 5

(1) Synthesis of Organic Particulate Emulsion 2

683 parts water, 3 parts of the sodium salt of methacrylic acid ethylene oxide adduct sulfate ester (Ereminol RS-30, Sanyo Chemical Industries), 83 parts styrene, 83 parts methacrylic acid, 110 parts butyl acrylate and 1 part of ammonium persulfate were introduced into a reaction vessel provided with a stirring rod and thermometer, and stirred at 150 rpm for 15 minutes. A white emulsion was thereby obtained. This was heated to raise the temperature in the system to 75° C., and reacted for 5 hours. Next, 30 parts of 1% aqueous ammonium persulfate solution was added, and reacted at 75° C. for 5 hours to obtain an aqueous dispersion of a vinyl resin (styrene-methacrylic acid—the sodium salt of butyl acrylate-methacrylic acid ethylene oxide adduct sulfate ester copolymer) [Resin Particulate Dispersion 2]. The weight average particle diameter of [Resin Particulate Dispersion 2] measured by LA-920 was 520 nm. Some of the [Resin Particulate Dispersion 2] was dried, and the resin content was isolated.

(2) [Toner 12] was obtained in an identical way to that of Example 1, except that [Resin Particulate Dispersion 2] was used instead of the [Resin Particulate Dispersion 1] in Example 1.

1.0 part of hydrophobic silica and 0.3 parts of hydrophobic titanium oxide were mixed by a Henschel mixer with 100 parts of the toners obtained in the Examples and Comparative Examples. The physical properties of the toners obtained are shown in Table 1.

A developer comprising 5% by weight of toner treated by an external additive and a silicone resin coated with 95% by weight of a copper-zinc ferrite carrier having an average particle size of 40 μm, was prepared. Using a Ricoh imagioNeo450 which can print 45 sheets of papers of A4 size per minute corresponding to ZESM (energy conservation standard corresponding to the zero emission standby mode in the technical supply program of next-generation copiers in the DSM (Demand Side Management) Program of the International Energy Agency (IEA) in fiscal 1999), continuous printing was performed, and the results evaluated according to the following criteria. The results are shown in Table 2.

(Evaluation Criteria)

(a) Particle Diameter

The toner particle diameter was measured with an aperture diameter of 100 μm using a Coulter Electronics Co. "Coulter Counter TA" particle size measuring apparatus. The volume average particle diameter and number average particle diameter were found using the aforesaid particle size measuring apparatus.

(b) Charging Amount 6 g of developer was measured, introduced into a sealable metal cylinder and blown, and the charging amount was calculated. The toner concentration was adjusted to 4.5% by weight to 5.5% by weight.

(c) Fixability

Using a Ricoh imagioNeo450, adjustment was performed so that 1.0±0.1 mg/cm$^2$ of toner was developed in the solid image of a transfer paper (Ricoh Type 6200 and NBS Ricoh copy printing paper <135>), adjustment was performed so that the fixing belt temperature could be varied, the temperature at which offset was not produced with regular paper was measured, and the minimum fixing temperature for thick paper was measured. The minimum fixing temperature was taken as the minimum fixing temperature with a fixing roller temperature at which the remainder of the image density after scratching the obtained fixed image with a pad was 70% or more.

(d) Circularity

The average circularity was measured by a flow type particle image analysis apparatus FPIA-2100 (To a Medical Electronics Co., Ltd.). In the actual measurement, 0.1 ml to 0.5 ml of a surfactant, preferably an alkylbenzenesulfonate, as dispersant, and approximately 0.1 g to 0.5 g of the measurement sample, were added to 100 ml to 150 ml of water from which impure solids had been removed, in a vessel. The suspension in which the sample had been dissolved, was subjected to dispersion treatment by an ultrasonic dispersion apparatus for approximately 1 minute to 3 minutes, and the toner shape and distribution were measured by the aforesaid apparatus with a dispersion concentration of 3,000/μl to 10,000/μl.

An image chart having a 5% image surface area was run off continuously to 100,000 sheets, and the following evaluation was performed.

(f) Image Density

After outputting a fill image, image density was measured by an X-Rite (X-Rite Co.). Measurements were performed at 5 points for each color, and the average for each color was calculated.

(g) Background Soiling

A blank paper image was stopped in development, the developer on the photoconductor after development was transferred to tape, and the difference from the image density of non-transferred tape was measured by a 938 Spectrodensimeter (X-Rite Co.).

(h) Cleaning Quality

Toner transfer residue on a photoconductor which had passed through a cleaning step was transferred to a blank paper with Scotch tape (Sumitomo 3M). This was measured with a Macbeth reflection densimeter RD514. A difference from the blank of 0.01 or less was evaluated as "AA" (good), and any larger difference was assessed as "X" (poor).

(i) Filming

The presence or absence of a toner filming situation on the developing roller or photoconductor was observed. "AA" means there was no filming, "A" means streak filming was observed, and "X" means filming on the whole body.

Note that "-" in Tables 1 and 2 shows that the measurement or evaluation was unable to obtain.

TABLE 1

| | | Toner particle diameter distribution | | | | | Fixing quality | |
|---|---|---|---|---|---|---|---|---|
| | Toner No. | Volume average particle diameter (μ) | Number average particle diameter (μ) | Dv/Dn | Toner shape Circularity | Toner viscoelasticity G' (180° C.) | Lower limit fixing temperature (° C.) | Hot offset temperature (° C.) |
| Example 1 | Toner 1 | 6.05 | 5.78 | 1.05 | 0.95 | 2180 | 145 | 240° C. or more |
| Example 2 | Toner 2 | 5.62 | 5.22 | 1.08 | 0.94 | 1020 | 130 | 240° C. |
| Example 3 | Toner 3 | 6.24 | 5.74 | 1.09 | 0.92 | 2470 | 150 | 240° C. or more |
| Example 4 | Toner 4 | 6.54 | 5.72 | 1.14 | 0.96 | 4380 | 160 | 240° C. or more |
| Example 5 | Toner 5 | 5.80 | 5.15 | 1.13 | 0.93 | 3520 | 155 | 240° C. or more |
| Example 6 | Toner 6 | 5.15 | 4.51 | 1.14 | 0.94 | 3880 | 160 | 240° C. or more |
| Example 7 | Toner 7 | 6.69 | 5.52 | 1.21 | 0.95 | 5430 | 165 | 230° C. |
| Comp. Ex. 1 | Toner 8 | 6.30 | 5.63 | 1.12 | 0.98 | 4400 | 190 | 230° C. |
| Comp. Ex. 2 | Toner 9 | 6.52 | 5.26 | 1.24 | 0.96 | 3560 | 175 | 225° C. |
| Comp. Ex. 3 | Toner 10 | 5.26 | 4.61 | 1.14 | 0.92 | 470 | 120 | 160° C. or less |
| Comp. Ex. 4 | Toner 11 | 7.82 | 6.52 | 1.20 | 0.98 | 10850 | 185 | 240° C. or more |
| Comp. Ex. 5 | Toner 12 | 7.24 | 3.92 | 1.85 | 0.98 | 1950 | 145 | 180° C. or less |

TABLE 2

| | | Toner charging amount (−μC/g) | | | Image density | | | Background soiling | | | Cleaning | | | Filming | |
|---|---|---|---|---|---|---|---|---|---|---|---|---|---|---|---|
| | Toner No. | Start | After 10000 sheets | After 100000 sheets | Start | After 10000 sheets | After 100000 sheets | Start | After 10000 sheets | After 100000 sheets | Start | After 10000 sheets | After 100000 sheets | After 100000 sheets | Overall eval-uation |
| Example 1 | Toner 1 | 33.5 | 30.1 | 30.6 | 1.43 | 1.45 | 1.43 | 0.00 | 0.01 | 0.00 | AA | AA | AA | AA | AA |
| Example 2 | Toner 2 | 28.3 | 26.5 | 24.5 | 1.46 | 1.45 | 1.44 | 0.01 | 0.02 | 0.02 | AA | AA | AA | AA | AA |
| Example 3 | Toner 3 | 34.2 | 31.9 | 29.6 | 1.42 | 1.40 | 1.39 | 0.00 | 0.00 | 0.02 | AA | AA | AA | AA | AA |
| Example 4 | Toner 4 | 35.3 | 32.4 | 31.2 | 1.41 | 1.44 | 1.42 | 0.00 | 0.01 | 0.00 | AA | AA | AA | AA | AA |
| Example 5 | Toner 5 | 35.1 | 33.1 | 31.0 | 1.39 | 1.41 | 1.42 | 0.00 | 0.00 | 0.00 | AA | AA | AA | AA | AA |
| Example 6 | Toner 6 | 34.6 | 32.6 | 30.5 | 1.42 | 1.38 | 1.41 | 0.01 | 0.00 | 0.01 | AA | AA | AA | AA | AA |
| Example 7 | Toner 7 | 38.3 | 35.8 | 33.1 | 1.35 | — | — | 0.00 | 0.00 | 0.01 | AA | AA | AA | AA | AA |
| Comp. Ex. 1 | Toner 8 | 32.5 | — | — | 1.28 | 1.44 | — | 0.02 | — | — | X | — | — | — | X |
| Comp. Ex. 2 | Toner 9 | 34.6 | 16.7 | — | 1.36 | — | — | 0.02 | 0.41 | — | AA | AA | — | — | X |
| Comp. Ex. 3 | Toner 10 | 21.0 | — | — | 1.43 | — | — | 0.01 | — | — | AA | — | — | — | X |
| Comp. Ex. 4 | Toner 11 | 39.1 | — | — | 1.33 | — | — | 0.00 | — | — | X | — | — | — | X |
| Comp. Ex. 5 | Toner 12 | 30.1 | — | — | 1.33 | — | — | 0.00 | — | — | X | — | — | — | X |

Toners 8, 9, 10, 11 and 12 could not be used for continuous printing due to poor fixing, and the evaluation was stopped. Also, for Toner 9, slight fixing defects occurred, and after 10,000 sheets, due to increased background soiling from loss of charge, continuous printing could not be carried out and the evaluation was stopped.

The present invention provides a toner having a stable negative charging quality, good initial print quality, excellent image clarity in continuous printing and stable cleaning properties, and good anti-offset properties, as well as an excellent low temperature fixing quality which prevents soiling due to filming on the photoconductor and developing roller, and further provides a developer comprising this toner, an image-forming method using this toner, a toner container, a process cartridge and an image-forming apparatus.

What is claimed is:

1. A toner having a storage elastic modulus (G') of from 500 Pa to 10,500 Pa at a frequency of 1 Hz and temperature of 180° C., wherein the toner is formed from a toner composition which comprises a binder resin, the toner composition is subjected to one of dissolution and dispersion in an organic solvent so as to form one of a solution and a dispersion, one of the solution and the dispersion is dispersed in an aqueous medium containing fine resin particles which have an average particle diameter of 500 nm or less, and the obtained aqueous dispersion is subjected to removal of a solvent thereof so as to obtain the toner.

2. A toner according to claim 1, wherein the storage elastic modulus (G') is from 700 Pa to 7,000 Pa at a frequency of 1 Hz and temperature of 180° C.

3. A toner according to claim 1, wherein the binder resin comprises a modified polyester resin (i) and a non-modified polyester resin (ii), wherein the weight ratio of the modified polyester resin (i) to the non-modified polyester resin (ii), is from 5/95 to 75/25.

4. A toner according to claim 1, wherein the binder resin has an acid value of from 0.5 mgKOH/g to 40 mgKOH/g.

5. A toner according to claim 1, wherein the binder resin has a glass transition temperature (Tg) of from 40° C. to 70° C.

6. A toner according to claim 1, wherein the fine resin particles are particles of one of a vinyl resin, a polyurethane resin, an epoxy resin, a polyester resin, and a mixture thereof.

7. A toner according to claim 1, wherein the fine resin particles have an average particle diameter of from 5 nm to 500 nm.

8. A toner according to claim 1, wherein the fine resin particles have a volume average particle diameter of from 4 μm to 8 μm.

9. A toner according to claim 1, wherein the toner consists of toner particles which have a ratio of a volume average particle diameter (Dv) to a number average particle diameter (Dn) being from 1.10 to 1.25.

10. A toner according to claim 1, wherein the toner consists of toner particles which have an average circularity of 0.90 to 0.96.

11. A toner according to claim 1, wherein the toner consists of toner particles which are in a spindle shape.

12. A toner according to claim 1, wherein the toner consists of toner particles in which the toner particles have a major axis $r_1$, a minor axis $r_2$, and a thickness $r_3$, a ratio of the major axis $r_1$ to the minor axis $r_2$ is from 0.5 to 0.8 and a ratio of the thickness $r_3$ to the minor axis $r_2$ is from 0.7 to 1.0.

13. A toner according to claim 1, wherein the removal of the solvent is carried out by at least one of stirring and heating of the aqueous dispersion.

14. An image-forming process, comprising the steps of:

uniformly charging a surface of a photoconductor and emitting light to the surface of the photoconductor imagewise so as to form a latent electrostatic image on the photoconductor;

supplying a toner to the surface of the photoconductor so that the latent electrostatic image is visualized to form a toner image on the photoconductor;

transferring the toner image to a recording medium; and recovering the remained toner on the photoconductor after the step of transferring and re-using the recovered toner in the step of supplying, wherein the toner have a storage elastic modulus (G') of from 500 Pa to 10,500 Pa at a frequency of 1 Hz and temperature of 180° C., wherein the toner is formed from a toner composition which comprises a binder resin, the toner composition is subjected to one of dissolution and dispersion in an organic solvent so as to form one of a solution and a dispersion, one of the solution and the dispersion is dispersed in an aqueous medium containing fine resin particles which have an average particle diameter of 500 nm or less, the obtained aqueous dispersion is subjected to removal of a solvent thereof so as to obtain the toner.

15. An image-forming apparatus, comprising:

a photoconductor;

a developing unit configured to supplying a toner to a latent electrostatic image formed on the photoconductor so as to form a toner image;

a transfer unit configured to transfer the toner image to a recording medium; and a recycle unit configured to recover the remained toner on the photoconductor after the toner image is transferred, and re-use the toner in the developing unit, wherein the toner has a storage elastic modulus (G') of from 500 Pa to 10,500 Pa at a frequency of 1 Hz and temperature of 180° C., wherein a toner composition of the toner, comprises a binder resin, the toner composition is subjected to one of dissolution and dispersion in an organic solvent so as to form one of a solution and a dispersion, one of the solution and the dispersion is dispersed in an aqueous medium containing fine resin particles which have an average diameter of 500 nm or less, the obtained aqueous dispersion is subjected to removal of a solvent thereof so as to obtain the toner.

16. The toner according to claim 1, wherein said binder resin comprises a modified polyester resin.

17. The toner according to claim 16, wherein said modified polyester resin is capable of reacting with a compound having an active hydrogen group.

18. The toner according to claim 1, wherein said one of the solution and the dispersion is subjected to reaction with a compound having an active hydrogen group, while being dispersed in the aqueous medium.

* * * * *